US007856115B2

(12) United States Patent
Clair et al.

(10) Patent No.: US 7,856,115 B2
(45) Date of Patent: Dec. 21, 2010

(54) OPTIMIZED MOVING-COIL LOUDSPEAKER

(75) Inventors: Roy B. Clair, Lititz, PA (US); Joshua M. Sadd, Elizabethtown, PA (US)

(73) Assignee: Clair Brothers Audio Systems Inc.

( * ) Notice: Subject to any disclaimer, the term of this patent is extended or adjusted under 35 U.S.C. 154(b) by 0 days.

(21) Appl. No.: 12/325,131

(22) Filed: Nov. 28, 2008

(65) Prior Publication Data

US 2009/0141926 A1 Jun. 4, 2009

Related U.S. Application Data

(60) Provisional application No. 61/004,909, filed on Nov. 30, 2007.

(51) Int. Cl.
*H04R 25/00* (2006.01)

(52) U.S. Cl. ..... 381/404; 381/398; 381/403

(58) Field of Classification Search ..... 381/396, 381/400, 401, 405, 412, 417, 418, 423, 432, 381/182, 186, 403, 404; 310/81
See application file for complete search history.

(56) References Cited

U.S. PATENT DOCUMENTS

| | | | | |
|---|---|---|---|---|
| 4,000,381 | A * | 12/1976 | Plice et al. | 381/418 |
| 4,239,943 | A | 12/1980 | Czerwinski | |
| 4,323,737 | A | 4/1982 | Shimada | |
| 4,472,605 | A | 9/1984 | Klein | |
| 5,371,806 | A | 12/1994 | Kohara | |
| 5,714,721 | A | 2/1998 | Gawronski | |
| 5,748,760 | A | 5/1998 | Button | |
| 5,809,157 | A * | 9/1998 | Grumazescu | 381/412 |
| 5,848,174 | A | 12/1998 | Ki | |
| 6,170,603 | B1 | 1/2001 | Bachmann | |
| 6,526,151 | B1 | 2/2003 | Peng | |
| 6,768,806 | B1 | 7/2004 | Button | |
| 6,778,677 | B2 * | 8/2004 | Coffin | 381/418 |
| 7,024,014 | B1 | 4/2006 | Noll | |
| 7,062,064 | B2 | 6/2006 | Bachmann | |
| 7,130,430 | B2 | 10/2006 | Milsap | |

FOREIGN PATENT DOCUMENTS

| | | |
|---|---|---|
| FR | 1180456 | 6/1959 |
| WO | WO 98/53638 | 11/1998 |
| WO | WO 2004/112428 | 12/2004 |

OTHER PUBLICATIONS

Button, Douglas J. "Magnetic Circuit Design Methodologies for Dual-Coil Transducers." J. Audio Eng. Soc., Jun. 2002, 427-441, vol. 50, No. 6.

International Preliminary Report on Patentability, International Application PCT/US2008/085082, published Jun. 2, 2010.

* cited by examiner

*Primary Examiner*—Huyen D Le
(74) *Attorney, Agent, or Firm*—Montgomery, McCracken.; Robert R. Axenfeld

(57) ABSTRACT

An optimized moving-coil loudspeaker is described herein. The loudspeaker includes an acoustic-radiating diaphragm that is non-cylindrical shape. The diaphragm is a substantially-planar substrate having uniform density. A moving-coil assembly is coupled to the acoustic-radiating diaphragm. The assembly is configured to move back and forth in a linear fashion. As the assembly is connected to the diaphragm it causes acoustic waves to be emitted from a front surface the acoustic-radiating diaphragm. The acoustic-radiating diaphragm is not supported by a conventional basket, among other differences.

15 Claims, 22 Drawing Sheets

OPTIMIZED MOVING-COIL LOUDSPEAKER

CROSS REFERENCE TO RELATED APPLICATIONS

The present patent application claims the benefit of U.S. Provisional Application Ser. No. 61/004,909 filed on 30 Nov. 2007, which is incorporated herein by reference in its entirety. The present application also relates to U.S. Non-Provisional application Ser. No. 12/325,128 filed concurrently herewith

TECHNICAL FIELD

This invention relates to loudspeakers, and more particularly, to a new style of moving-coil loudspeaker suited for use in both linear- and planar-array loudspeaker systems.

BACKGROUND

A common type of loudspeaker in use today is known as a moving-coil loudspeaker. This speaker includes a transducer which converts electrical signals into mechanical energy. This mechanical energy is applied to a radiating diaphragm, which converts the mechanical energy into acoustical energy.

Moving-coil loudspeakers include a cone-shaped radiating diaphragm that is interconnected to a rigid "basket," via a flexible suspension system. The basket is typically cast or stamped metal, or a resilient plastic, and is cylindrical in shape. The basket is designed for rigidity to avoid deformation as the main structural element of the loudspeaker.

A typical suspension system consists of one or more compliant members, a spider and a surround. The purpose of these elements is to maintain axial stability of the moving transducer while providing a restoring force to the speaker. Most moving-coil speakers also include a dust cap covering a central hole in the diaphragm to prevent contaminants—such as metal shavings—to enter the inside of a speaker. Such shavings can short out, or cause the speaker to malfunction.

At present, most moving-coil type speakers are conical in depth and cylindrical in shape. When such speakers are aligned in an elongated-array system, inter-element spacing is dictated by the basket frame dimensions. In addition to that, they are only tangentially coupled which leaves segments of baffle area between adjacent speakers that are not contributing to sound creation. This dead area (i.e. a discontinuity in the array) functions only as a diffraction boundary which degrades the sonic performance of the system.

Another class of speakers, known as "flat-panel loudspeakers" generally consist of a lightweight membrane, herein referred to as "acoustic-radiating diaphragm", and a drive system. In one class of these flat-panel loudspeakers, the acoustic radiating surface is actuated into motion by an electrodynamic transducer which is mechanically coupled to the radiating surface. Measures are taken in the design of these panel speakers to ensure that the panel attains oscillation resonances which add to the acoustical output. These devices are generically called "multi-resonance" or "bending-wave" loudspeakers. A major drawback of multi-resonance/bending-wave loudspeakers, however, is their inability to accurately generate an acoustical reproduction of the electrical-stimulus signal, used to drive these speakers. More particularly, the undesired panel resonances color the impulse responses of these multi-resonance/bending-wave loudspeakers.

Another class of flat-panel loudspeakers utilizes the radiating membrane as an integral part of the transducer structure. This includes electrostatic and magnetostatic devices. In the case of both, they lack pistonic motion over the entire surface acoustic-radiating diaphragm to accurately reproduce low frequencies at equal amplitude levels to match the capabilities of the device at midrange and high frequencies. Generally, practical electrostatic speakers operate over a limited bandwidth, and require the support of additional conventional speakers for low frequency supplementation.

The foregoing describes only a sample of some drawbacks of conventional loudspeakers in use today.

SUMMARY

An optimized moving-coil loudspeaker is described herein. The loudspeaker includes an acoustic-radiating diaphragm that is non-cylindrical shape. The diaphragm is a substantially-planar substrate having uniform density. A moving-coil assembly is coupled to the acoustic-radiating diaphragm. The assembly is configured to move back and forth in a linear fashion. As the assembly is connected to the diaphragm it causes acoustic waves to be emitted from a front surface the acoustic-radiating diaphragm.

The foregoing outlines an embodiment of the invention so that those skilled in the relevant art may better understand the detailed description that follows. Additional embodiments and details will be described hereinafter. Those skilled in the relevant art should appreciate that they can readily use any of these disclosed embodiments as a basis for designing or modifying other structures or functions for carrying out the invention, without departing from the spirit and scope of the invention.

BRIEF DESCRIPTION OF THE DRAWINGS

The detailed description is explained with reference to the accompanying figures. In the figures, the left-most digit(s) of a reference number identifies the figure in which the reference number first appears. The figures are not drawn to scale.

Specifically, FIG. 27 depicts an exemplary wiring configuration in which all voice coils of all four transducers are wired in parallel to one set of terminals.

FIG. 28 depicts a wiring configuration in which the top row of array transducers are wired in parallel with one another to one set of input terminals, while the bottom row of array elements are wired in parallel with another set of input terminals.

FIG. 29 shows a plurality of pairs of positive and negative electrical terminals, with each pair of positive and negative electrical terminals driving a respective one of the plurality of piston-based inductors individually.

FIG. 30 shows a configuration in which pairs of voice coils which are common to the same linear transducer are in parallel, but array elements are wired in series with one another. The series combination of all of the motors is wired to one set of input terminals.

FIG. 31 shows a configuration in which the top row of array elements are wired in series with each other as are the elements of the bottom row. Each series has its own set of input terminals.

FIG. 32 shows another configuration in which the rows are wired in series and the columns are wired in parallel with one another to one set of input terminals.

DETAILED DESCRIPTION

1.0 Introduction

Figure 1:
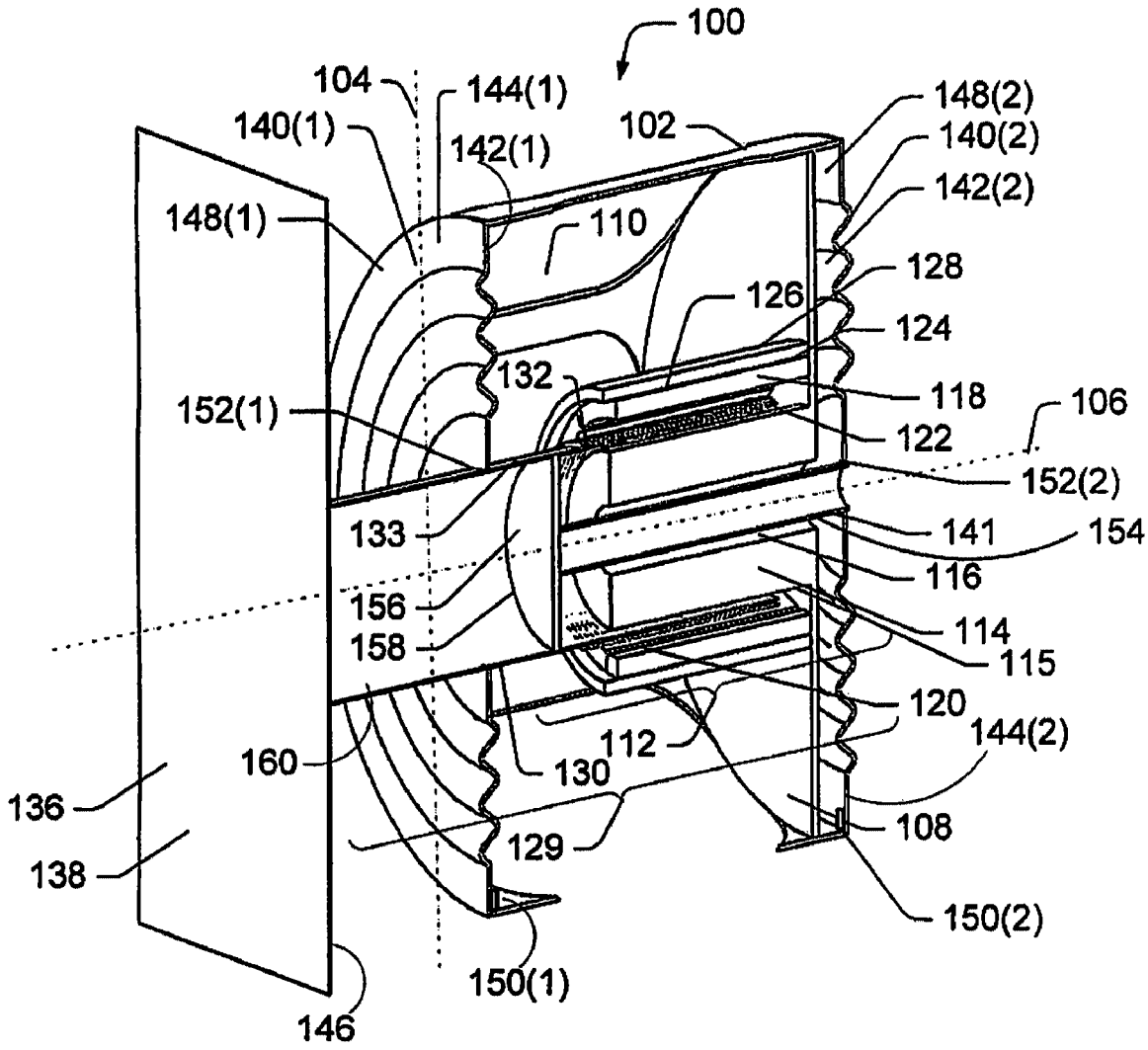
FIG. 1 is a cut-away-sectional-perspective view of a loudspeaker constructed in accordance with one embodiment of the invention.

Described herein is a new style of moving-coil loudspeaker optimized for array applications. In a first embodiment, a transducer assembly is disposed between two compliant members. Stationary components of the transducer assembly (including peripheral sections of the two compliant members) are supported by a housing. Moving components of the transducer assembly—such as a voice-coil former, and voice coil—are stabilized by central portions of the two compliant members. A shaft passing through a central chamber of the transducer assembly connects (directly or indirectly) the voice-coil former to at least one of the compliant members. Thus, central portions of the compliant members, the voice-coil former, and the shaft, move in unison. An acoustical-radiating surface is located external to the compartment that contains the transducer assembly, which is formed by the two compliant members, and the housing. That is, the acoustic-radiating diaphragm is positioned generally in parallel with, and a predefined distance away from, an outer-surface of one of the compliant members. The acoustical-radiating surface also moves in unison with the moving components, and is generally continuous, and may be planar (as opposed to conical) as well non-cylindrical in shape.

In another embodiment, the transducer assembly may include more than one transducer. For example, a first and second transducer may be positioned between the inner surfaces of the first and second compliant members. In this configuration, the shaft extends, at least in part, through a central chamber located within both transducers, and provides a mechanical linkage—at least in part—between the compliant members. The loudspeaker also includes an acoustic-radiating diaphragm, connected (either directly or indirectly) to the voice-coil former of the transducer assembly. The first and second transducers may have magnets oriented to produce identical magnetic fields, and include inductive coils that are phase inverted to provide coincident-linear motion of the voice-coil formers. The combination of back-to-back transducers reduces harmonic distortion and increases overall power handling of the loudspeaker.

In still another embodiment, the acoustic-radiating diaphragm of the loudspeaker, may be non-conical as well as non-cylindrical in shape. For example, the radiating surface of the diaphragm may be square, rectangular, or even hexagonal. In yet another embodiment, the acoustic-radiating diaphragm includes a radiating surface with no voids.

In one embodiment, the system includes a transducer-array module having a plurality of piston-based transducers (such as the transducer assemblies described herein). As used herein, a piston-based transducer means a type of transducer that incorporates a moving coil. Each transducer is configured to drive a particular one of a plurality of discrete non-concentric acoustic-radiating diaphragms. The system also includes a frame positioned around the plurality of discrete non-concentric acoustic-radiating diaphragms. The transducer-array module may be used in array configurations, including but not necessarily limited to, a line, planar, and phased arrays.

When one or more transducer-array modules are used in array applications, it is possible to eliminate (or greatly reduce) interspatial distances between acoustical centers of each acoustic-radiating-radiating diaphragm, which produces a more coherent wave front from the entirety of the array.

Based on the foregoing, this invention introduces the broad concept of an improved moving-coil-loudspeaker design, in which the surround, basket, dust cap, and other conventional components can be eliminated entirely. As a result, the radiating surface of a moving-coil loudspeaker may be non-cylindrical and non-conical in shape. Thus, acoustical sound emitted from an individual speaker is improved, and sound interference between a plurality of speakers in an array is minimized. That is, there are little-to-no discontinuities in the array, so an ideal isophase-acoustic wavefront is produced. Additionally, it is possible to steer the focal point of sound in space emitted from the plurality of speakers.

Reference herein to "one embodiment", "an embodiment", or similar formulations herein, means that a particular feature, structure, operation, or characteristic described in connection with the embodiment, is included in at least one embodiment of the present invention. Thus, different appearances of such phrases or formulations herein do not necessarily refer to the same embodiment. Furthermore, various particular features, structures, operations, or characteristics may be combined in any suitable manner in one or more embodiments.

1.0 Single-Transducer Embodiment

For purposes of description herein, the terms "front," "back," "rear," "top," "central," "bottom," "vertical," "horizontal," and derivatives thereof shall relate to implementations of the invention as shown in FIG. 1. It is understood by those skilled in the art, however, that the invention may assume other orientations, except where specified to the contrary. Furthermore, specific dimensions relating to the embodiments disclosed herein are not to be considered limiting, unless a claim expressly states otherwise.

FIG. 1 is a cut-away-sectional-perspective view of a loudspeaker 100 constructed in accordance with one embodiment of the invention. Loudspeaker 100 includes a stationary assembly, moving assembly, and axial-stability assembly. Each assembly shall be described in more detail below.

1.1 Exemplary-Stationary Assembly

As depicted in FIG. 1, loudspeaker 100 includes a housing 102 which serves as a support structure for components of loudspeaker 100. Housing 102 may be constructed of any suitable material that can withstand the rigors of being transported, as well forces imparted by the moving and stationary components of loudspeaker 100. In one embodiment, housing is constructed of a metal, which is non-ferrite material. Housing 102 may consist of other materials such as plastic, aluminum, fiberglass, wood, or combinations thereof. Housing 102 is a single integrated piece of material, as the result of a cast or stamping process. However, housing 102 may also consist of multiple pieces joined together by fastening mechanisms, such as welds, glue, rivets, etc.

In one embodiment, housing 102 is generally cylindrical in shape, and has a vertical axis 104. Housing 102 has a horizontal axis 106. Housing 102 may include a back plate 108, and open cylindrical front area 110. As appreciated by those skilled in the art after having the benefit of this disclosure, housing 102 may be of other sizes, and shapes, such as spherical, rectangular, or other configurations.

Housing 102 contains magnetic, mechanical, and electromagnetic devices, while providing a stable framework from which the loudspeaker may operate. For example, disposed within housing 102 is a transducer assembly 112.

Initially referring to the stationary components of transducer assembly 112, transducer assembly 112 includes a pole piece 114, which is a cylindrical structure protruding from back-plate section 108 of housing 102. In one embodiment, pole piece 114 is an integrated extension of housing 102, however, pole piece 114 may also be fastened to back plate 108. Pole piece 114 is generally hollow and forms a chamber 116 that provides a central passageway through transducer assembly 112. Thus, pole piece 114 forms chamber 116, which is concentric around horizontal axis 106.

Spaced apart from pole piece 114 are one or more magnets 118 also concentric about horizontal axis 106. That is, inner surfaces 120 of magnets 118 encircle pole piece 114, and are separated a distance D' from an outer surface 122 of pole piece 114. Thus, magnets 118 form a concentric ring having a circumference and diameter that is greater than pole piece 114. Magnets 118 may include liquid encased ferrites, and/or solid materials.

Magnetic housing 128 is cylindrical structure protruding from back-plate section 108 of housing 102. In one embodiment, magnetic housing 128 is an integrated extension of housing 102, however, magnetic housing 128 may also be fastened to back-plate section 108. Magnetic housing 128 is generally hollow.

Outer surfaces 124 of magnets 118 are affixed to an inner surface 126 of magnetic housing 128. For instance, magnets 118 may be glued to housing 128. As appreciated by those skilled in the art, magnets 118 may be joined to magnetic housing 128, such as by adhesive tape, rivets, plastic sheathing or by other suitable fastening means. Inner surface 126 of housing 128 is generally concentric about horizontal axis 106. That is, inner surface 126 of magnetic housing 128 encircles pole piece 114 and magnets 118. Thus, magnetic housing 128 forms a concentric ring having a circumference and diameter that is greater than pole piece 114 and the ring of magnets 118.

1.2 Exemplary-Moving Assembly

With respect to moving components, transducer assembly 112 also includes a voice-coil assembly 129. Voice-coil assembly 129 includes a voice-coil former 130, and voice coil 132. In one embodiment, voice-coil former 130 is a cylindrical hollow tube extending along horizontal axis 106, with horizontal axis 106 being the central axis point. Voice coil 132 is wrapped around a section of voice-coil former 130. Voice-coil former 130 is adjacent to, but spaced apart from pole piece 114. Voice-coil former 130 has a larger circumference than an outer surface 115 of pole piece 114. A section of voice-coil former 130, including voice coil 132 is also spaced apart from magnets 118, which have a larger circumference than voice coil 132 or voice-coil former 130. Thus, at least a portion of voice-coil former 130 and voice coil 132 is suspended between pole piece 114 and magnets 118. Voice-coil assembly 129 is suspended between pole piece 114 and magnets 118 by a compliant suspension assembly to be described in more detail below.

In one embodiment, voice-coil former 130 is comprised of a polyimide material. It is appreciated by those skilled in the art, after having the benefit of this disclosure that voice-coil former 130 may be comprised of other materials, such as paper, aluminum, fiberglass, carbon fiber, and other suitable materials.

Attached to a front end of voice-coil former 130 is an acoustic-radiating diaphragm 136. Voice-coil assembly 129 and acoustic-radiating diaphragm 136 are both configured to move back and forth, in unison, and in linear fashion along horizontal axis 106, in response to electro-magnetic energy being exchanged between voice-coil assembly 129 and the magnetic assembly portion of transducer assembly 112; such as magnets 118. Acoustical waves are emitted from a front surface 138 of acoustic-radiating diaphragm 136 in response to such linear movement.

1.3 Exemplary Axial-Stability Assembly

Axial-stability assembly includes compliant members 140(1), 140(2), and a shaft 141. Compliant members 140(1) and 140(2) are comprised of a flexible and resilient material, such as a corrugated fabric, paper, pulp/fiber blend, combinations of materials, or other suitable materials as appreciated by those skilled in the art. In one embodiment, each compliant member, referred to generally as reference number 140, is a spider. Each compliant member 140(1), 140(2) has inner surfaces 142(1), 142(2), and outer surfaces 144(1), 144(2). The surfaces extend along a vertical axis 104, which are generally orthogonal to horizontal axis 106 (i.e., perpendicular to horizontal axis 106). Inner surfaces 142(1), 142(2) oppose each other, (i.e. the surfaces are generally parallel and spaced apart).

As depicted in FIG. 1, transducer assembly 112 is generally disposed between inner surfaces 142(1), 142(2). Outer surface 144(1) of compliant member 140(1) opposes and is generally parallel with a back surface 146 of acoustical-radiating diaphragm 136. Inner surface 142(2) is positioned behind back plate 108. Outer peripheral edges 148(1), 148(2) of compliant members 140(1), 140(2), are attached to lips 150(1), 150(2) of housing 102. For example, compliant members 140 may be attached to lips 150 by an adhesive, or other suitable mechanical fastening mechanisms. Furthermore, as appreciated by those skilled in the art, it is possible to for compliant members 140 to be attached indirectly to housing 102, such by an intermediary member (not shown) such as a washer-type device.

A central-peripheral edge 152(1) of compliant member 140(1) is attached to external surface 133 of voice-coil former. For example, central-peripheral edge 152(1) is glued to external surface 133 of voice-coil former 130. As appreciated by those skilled in the art, central-peripheral edge 152(1) of compliant member 140(1) may be attached indirectly to voice-coil former 130, such as a clamping device (not shown) or other suitable intermediary devices.

A central-peripheral edge 152(2) of compliant member 140(2) is attached to external surface 133 of voice-coil former. For example, central-peripheral edge 152(2) is glued to external surface 154 of shaft 141. As appreciated by those skilled in the art, central-peripheral edge 152(2) of compliant member 140(2) may be attached indirectly to voice-coil former 130, such as a clamping device (not shown) or other suitable intermediary devices.

Shaft 141 extends through central chamber 116 along horizontal axis 106. Shaft 141 mechanically links voice-coil former 130 to compliant member 140(2). A front portion of shaft 141 is connected to voice-coil former 130 by a disc 156. Disc 156 may be integral with shaft 141. Alternatively, an internal portion of disc 156 may be joined to external surface 154 of shaft 141, by any suitable mechanical connection, such as glue.

Disc 156 has an external-perimeter surface 158 that is adjacent to, and coextensive with an inner surface 160 of voice-coil former 130. Disc 156 may be fastened to voice-coil former 130 by any suitable mechanical connection, such as glue. In one embodiment disc is titanium but may be other materials such as paper, aluminum, or other suitable materials and combinations thereof, and other suitable materials.

Thus, moving components of the transducer assembly 112—such as a voice-coil former 130, and voice coil 132—are stabilized by central portions 152 of compliant members 140(1), 140(2). Shaft 141 extends through central chamber 116 of transducer assembly 116, and suspends and supports voice-coil former 132 between compliant members 140(1), 140(2).

When transducer assembly 112 is operational, central portions 152 of compliant members 140, voice-coil former 130, voice coil 132, and shaft 141, move in unison. In other words, voice-coil former 130 (as well as voice coil 132 and shaft 141) move along horizontal axis 106 generally perpendicular to vertical axis 104, when loudspeaker 100 is operational. Central portions of complaint members 140 flex along horizontal axis 106, in either a convex or concave shape, in response to movement of voice-coil former/voice coil 130/132 and shaft 141 along horizontal axis 106. Displacement flexion of compliant members 140(1), 140(2) is greatest towards the central portions of each member, typically at locations closest to a moving component, such as voice-coil former 130, or shaft 141. Compliant members 140 stiffen and offer more tensile resistance at locations closer to the outer-radial sections of members 140 (i.e., peripheral edges 148(1), 148(2)) where each member 140 is fastened to housing 102.

Compliant members 140, therefore, support and provide axial stability to voice-coil assembly 129, while also providing restoring forces upon being displaced when loudspeaker is operational. Shaft 141 interconnects (directly or indirectly) a front section of voice-coil former 130 to rear compliant member 140(2). Additionally, transducer assembly 112 is disposed between compliant member 140(1) and 140(2). Stationary components of the transducer assembly 112 are supported by a housing including peripheral edges 148 of the compliant members 142.

Acoustical-radiating diaphragm 136 is located external to the compartment containing transducer assembly 112 formed by compliant members 140. That is, the acoustic-radiating diaphragm is positioned with its surfaces generally in parallel with, and a predefined distance away from outer-surface 144(1) compliant member 140(1). As mentioned above, acoustical-radiating surface also moves in unison with in voice-coil former 132. Axial stability for transducer assembly 112 is provided by components located behind acoustical-radiating diaphragm 136. Accordingly, front surface 138 of acoustical-radiating diaphragm 136 may be planar (as opposed to conical) as well non-cylindrical in shape. Additionally, unlike conventional speakers, no basket, suspension, or dust cap is required.

Figure 2:
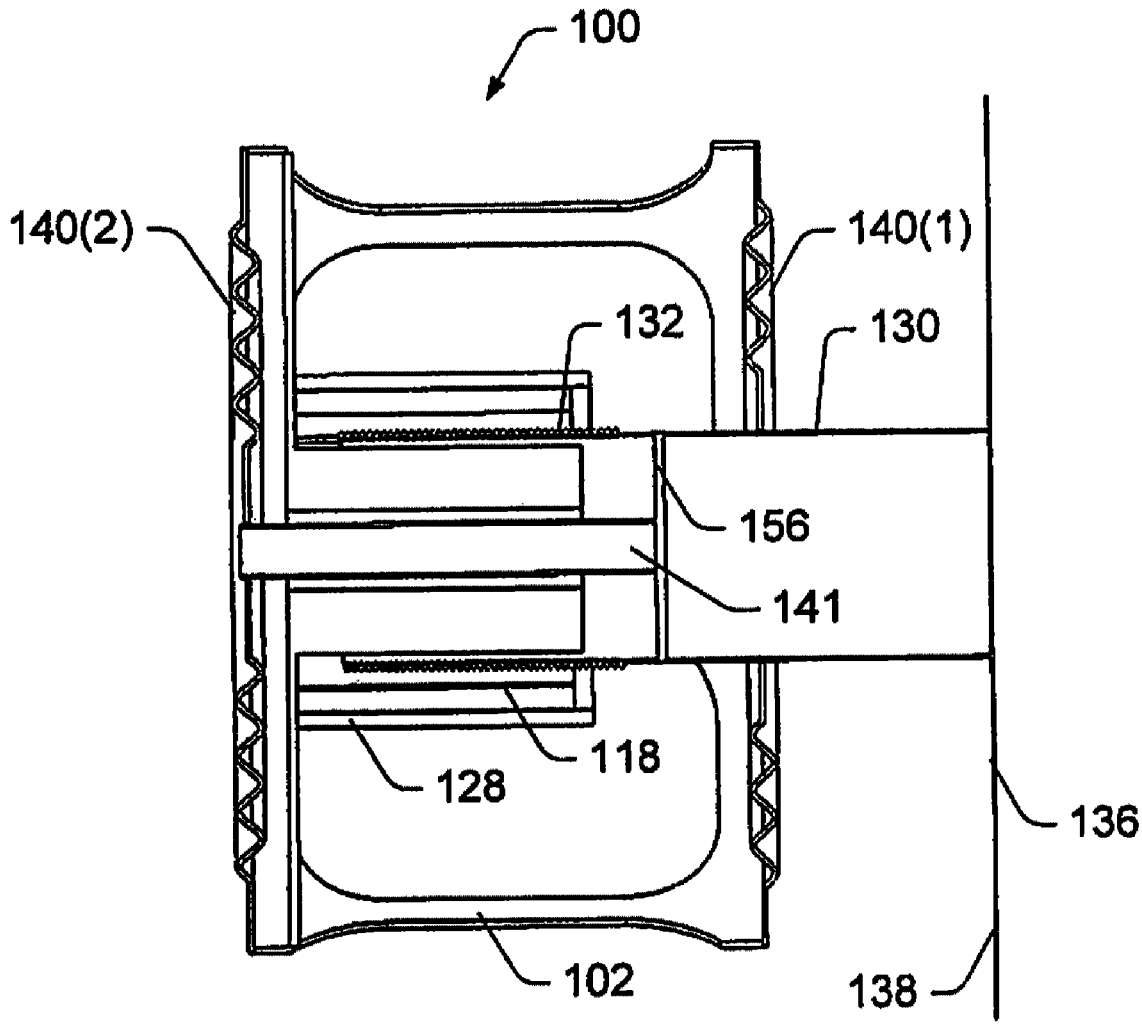
FIG. 2 shows a side cross-sectional view of the loudspeaker shown in FIG. 1.

FIG. 2 shows a side cross-sectional view of the loudspeaker 100 shown in FIG. 1.

Figure 3:
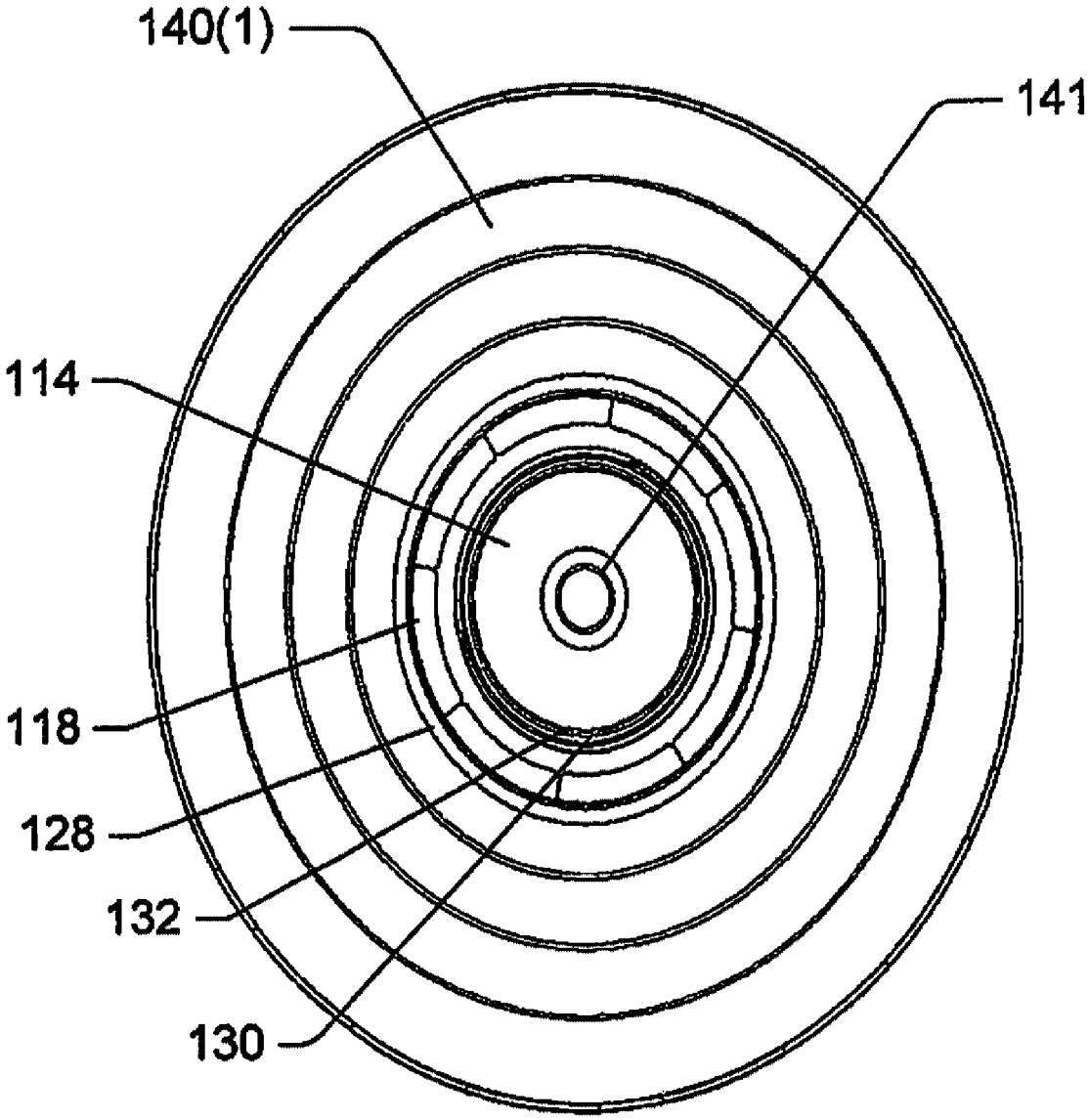
FIG. 3 shows a front view of loudspeaker at a location A shown in FIG. 2.

FIG. 3 shows a front view loudspeaker 100 at a location A' shown in FIG. 2. A portion of voice-coil former 132 and shaft 141 are shown in cross-section.

Figure 4:
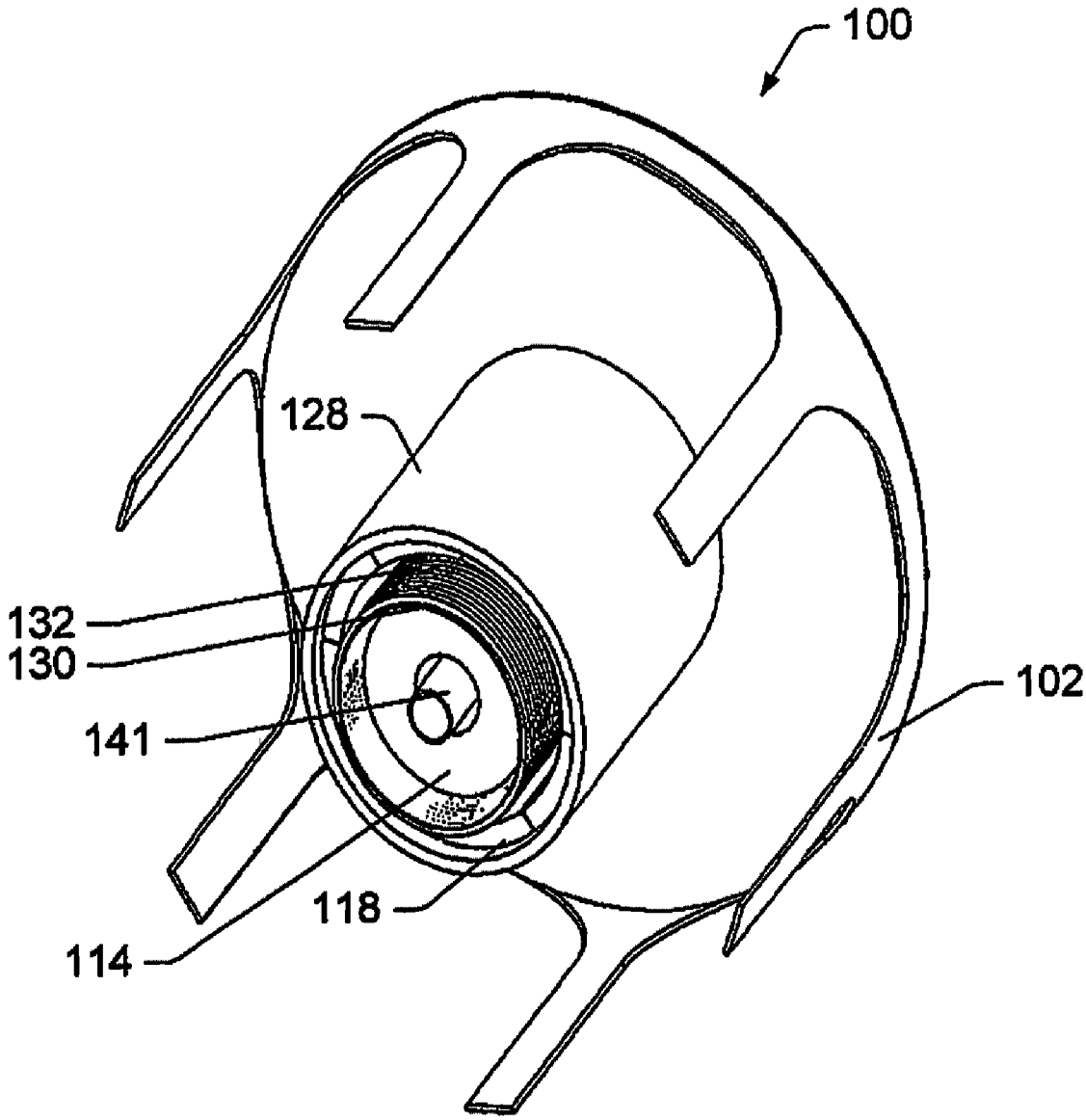
FIG. 4 shows a rear perspective view of the loudspeaker shown in FIG. 1.

FIG. 4 shows a rear perspective view of loudspeaker 100 shown in FIG. 1.

1.4 Exemplary-Magnetic Orientations

Figure 5:
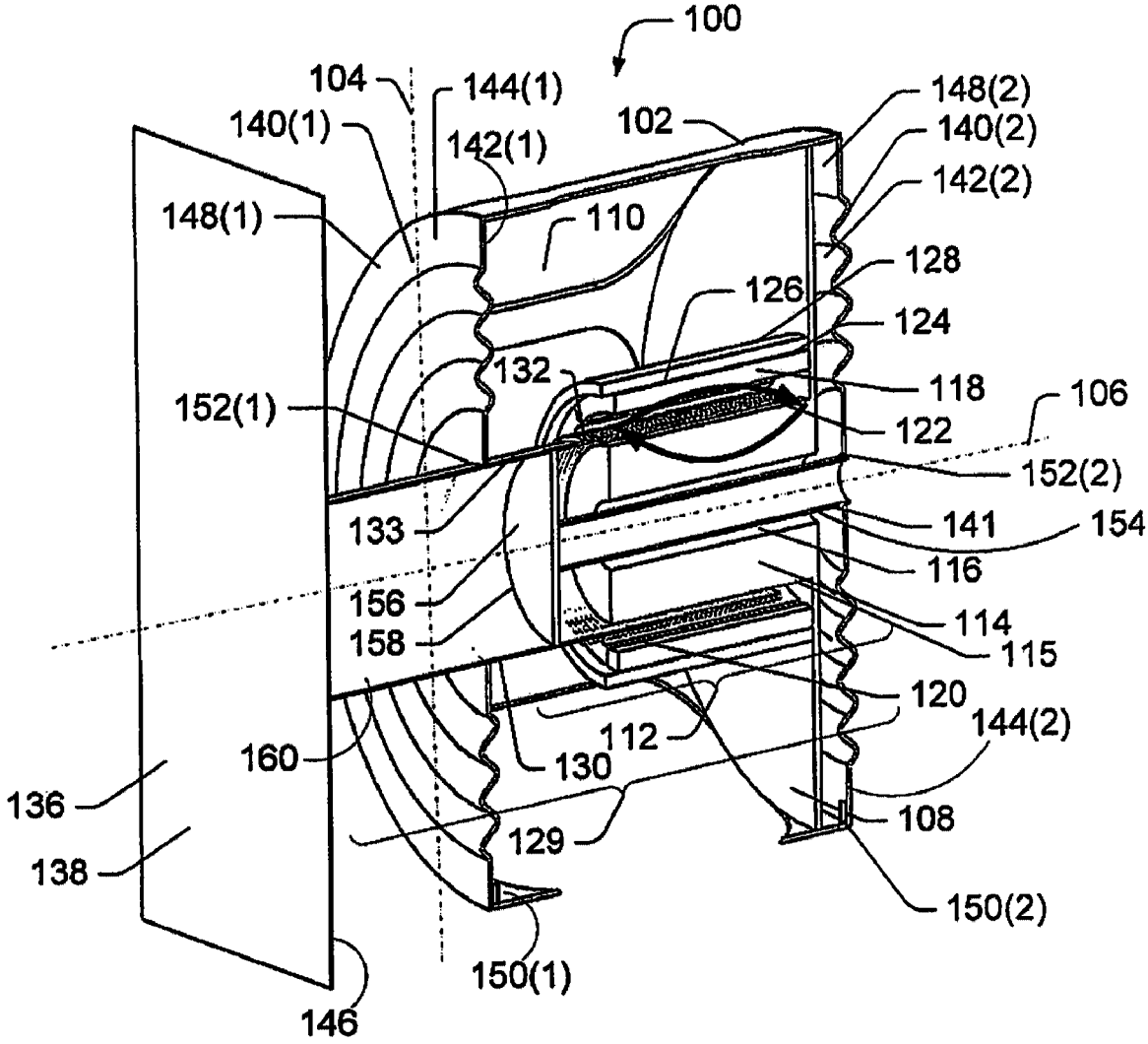
FIG. 5 shows another sectional-perspective view of a loudspeaker and an example arrangement for positioning of magnets fields.

FIG. 5 shows another cross-sectional perspective view of a loudspeaker 100 and an example arrangement for positioning of magnets fields. As depicted in FIG. 2, Magnets 118 form a stationary magnetic field for transducer assembly 112. Specifically, magnets 118 are oriented to produce a north-polarity-magnetic field closest to the front transducer assembly 112 and a south-polarity-magnetic toward the rear of transducer assembly 112. As appreciated by those skilled the art, however, orientation of magnetic polarity could also easily be reversed in other embodiments.

A time varying magnetic field is created by voice coil 132 when positive or negative electric current flows through voice coil 132. It is the force due to the interaction between the time varying magnetic field created by the voice coil, and the permanent-magnetic fields of magnets 118 (and associated assembly such as pole piece 114, and magnetic housing 128), which cause voice-coil assembly 129 to move back and forth in a linear fashion along horizontal axis 106. This piston-like linear movement causes acoustic waves to be emitted from front surface 138 of acoustic-radiating diaphragm 136.

1.5 Exemplary-Radiating Surfaces

Figure 6:
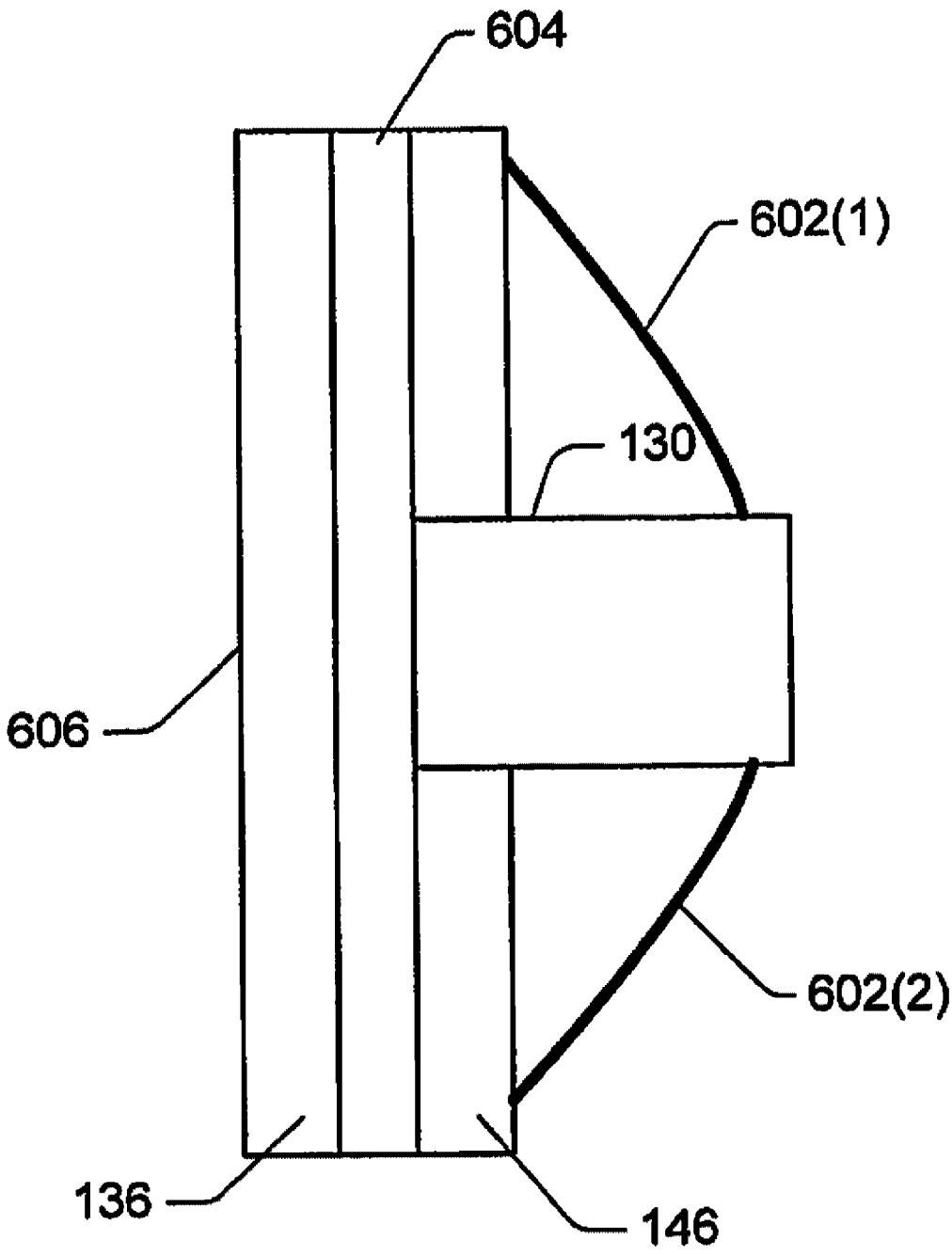
FIG. 6 shows a side sectional view of an acoustic-radiating diaphragm with an exemplary configuration for attaching to a voice-coil former.

FIG. 6 shows a side sectional view of acoustic-radiating diaphragm 136 with an exemplary configuration for attaching to voice-coil former 130. As depicted in FIG. 6, back surface 146 is attached to connecting arms 602(1), 602(2) by an adhesive. As appreciated by those skilled in the art having the benefit of having this disclosure there are other suitable ways to connect (directly or indirectly) voice-coil former 130 to acoustic-radiating diaphragm 136. For example, in another embodiment, an intermediary-supporting piece, such as a ring or spoke-like members, can connect acoustic-radiating diaphragm 136 to voice-coil former 130.

The radiating surface of acoustic-radiating diaphragm 136 (i.e., front surface 138 may be constructed from titanium, aluminum, foam with resin, foam and fiber, paper, organic fiber pulp, Kevlar, glass, carbon, solid plastic, any combination of the aforementioned materials, or other suitable materials as would be appreciated by those skilled in the art with the benefit of having this disclosure. For example, in one embodiment diaphragm 136 may include a front and back surfaces 138/146 composed of titanium, laminated together by a foam or resin core 604, or similar constructions, such as a honeycomb, or similar-related-composite sandwich structures.

In one implementation, acoustical-radiating diaphragm 136 has a density which varies as function of position with respect to a local origin (center point 606) of front surface 138.

Figure 7:
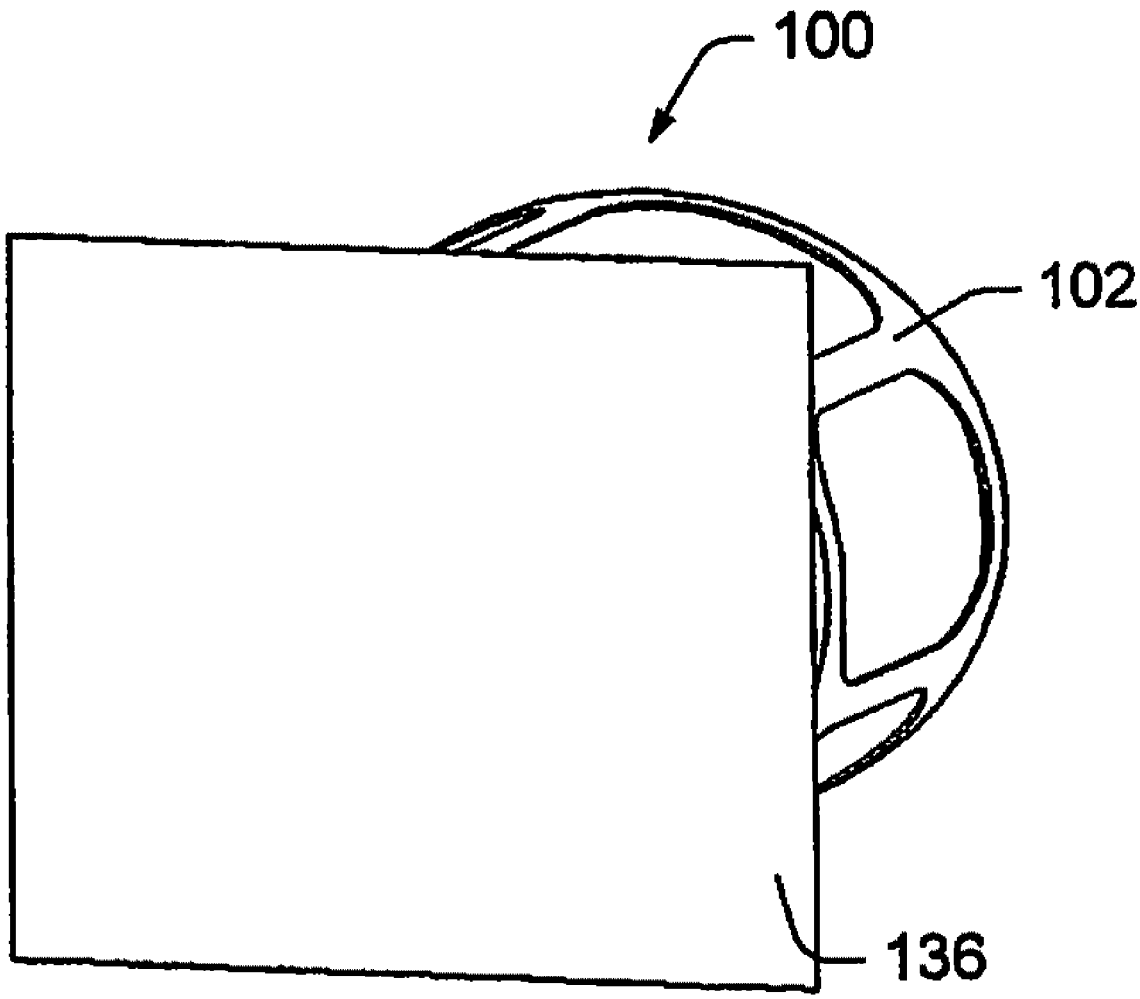
FIG. 7 shows a loudspeaker with an acoustical-radiating diaphragm having a square-shape.

FIG. 7 shows a loudspeaker 100 with an acoustical-radiating diaphragm 136 having a square-shape.

Figure 8:
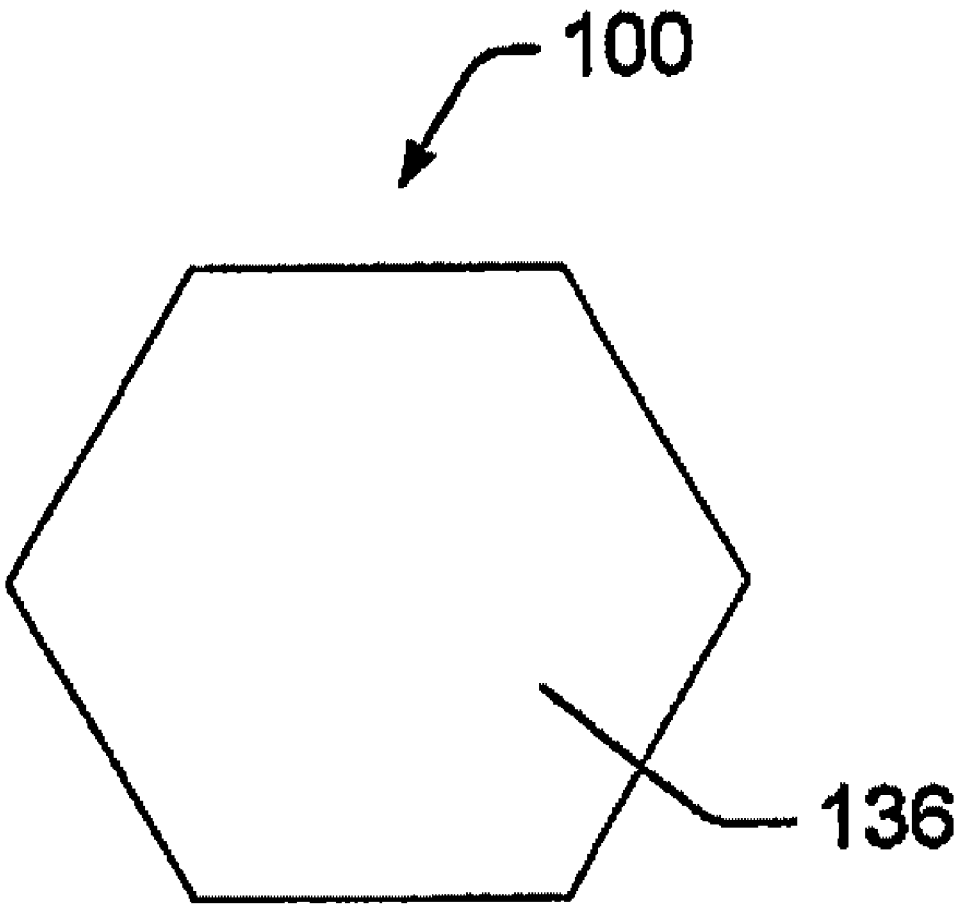
FIG. 8 shows a loudspeaker with an acoustical-radiating diaphragm having a hexagonal shape.

FIG. 8 shows a loudspeaker 100 with an acoustical-radiating diaphragm 136 having a hexagonal shape.

Additionally, acoustical-radiating diaphragm 136 may have a flat, convex, or concave surface.

2.0 Multiple-Transducer Embodiment

Figure 9:
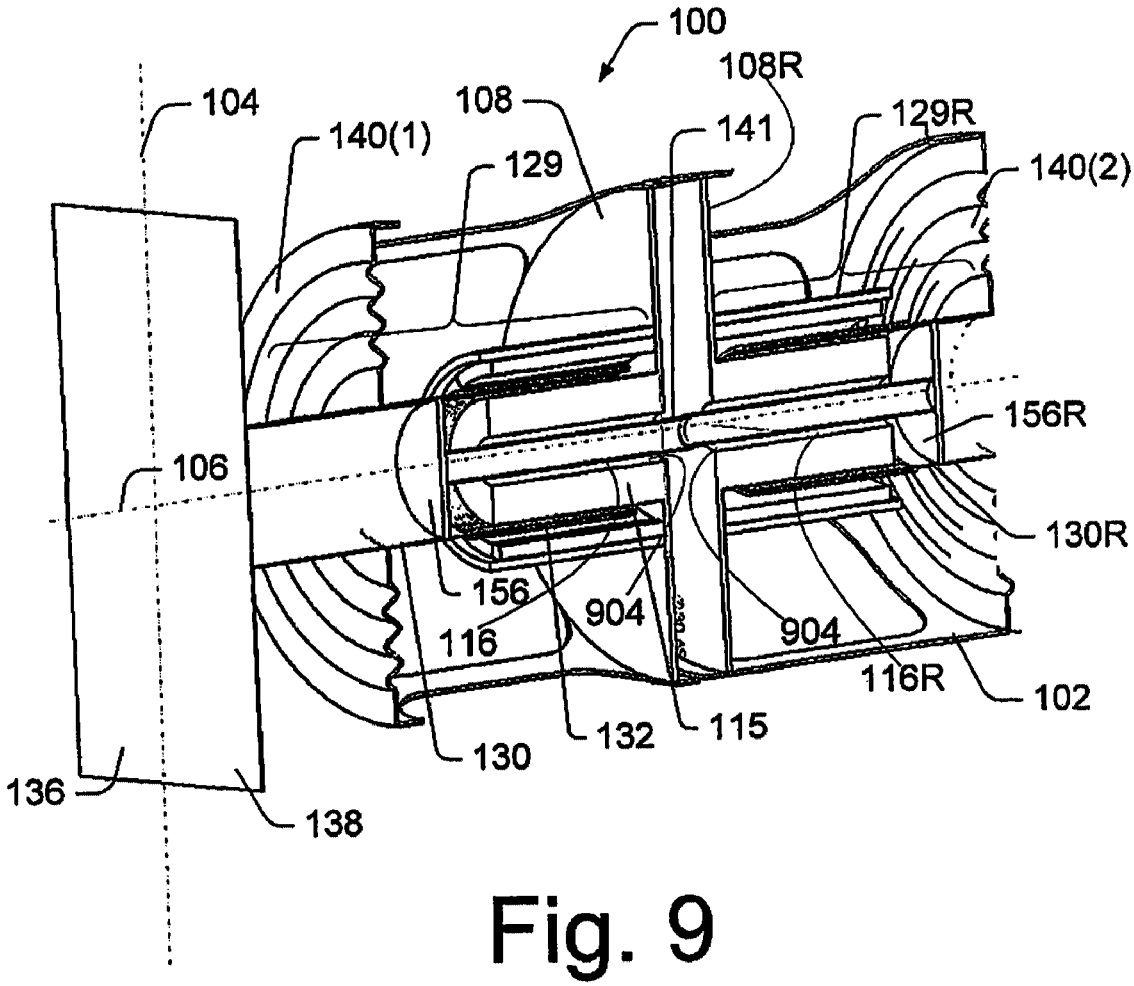
FIG. 9 is a cut-away-sectional-perspective view of a loudspeaker constructed in accordance with an embodiment of the invention.

FIG. 9 is a cut-away-sectional-perspective view of a loudspeaker constructed in accordance with an embodiment of the invention. Specifically, FIG. 9 shows a loudspeaker 100 that includes two transducer assemblies 902(1), 902(2) positioned back-to-back with each other. Each transducer assembly 902(1), 902(2) is identical to the transducer assembly as shown in FIG. 1 and described above. Rear-compliant member 140(2), however, is now connected to voice-coil assembly 129R to function as a "quasi" front-compliant member for rear transducer 902(2). Shaft 141 still extends along horizontal axis 106 and is positioned with a central chamber 116 of both transducers. Shaft 141 provides, at least in part, a mechanical linkage between the voice-coil formers 130 and 130R. Additionally, compliant members 140(1), and 140(2) are configured to suspend voice coils 132 and 132R, as well as permit reciprocating motion of voice-coil formers 130, 130R, which move in unison with each other, generally perpendicular to vertical axis 104.

As depicted in FIG. 9, only one acoustic-radiating diaphragm 136 is needed, and rear-transducer assembly 902(2) terminates with its voice-coil former 130R attached to a central portion 152(2) of compliant member 140(2). Also, shaft 141 extends through a hole 904 located in back plates 108, 108R of housing 102. Shaft 141 is connected to voice-coil formers 130, 130R by discs 156, 156R.

In one embodiment, voice coils 132, 132R have inductive coils that are phase inverted to provide coincident-linear motion of voice-coil former 130, 130R. As appreciated by those skilled in the art, it is also possible to keep the phase of the coils identical, but change the magnetic field orientation of transducer assemblies 902(1), 902(2).

This back-to-back transducer design for loudspeaker 100 provides a fully symmetric loudspeaker design with full symmetry of magnetic force factor (BL(x)) and spring force (K(x)) (where x is measured along the central axis) with approximately twice the power, and reduced harmonic distortion.

3.0 Exemplary Transducer Implementation with No Central-Connecting Rod

Figure 10:
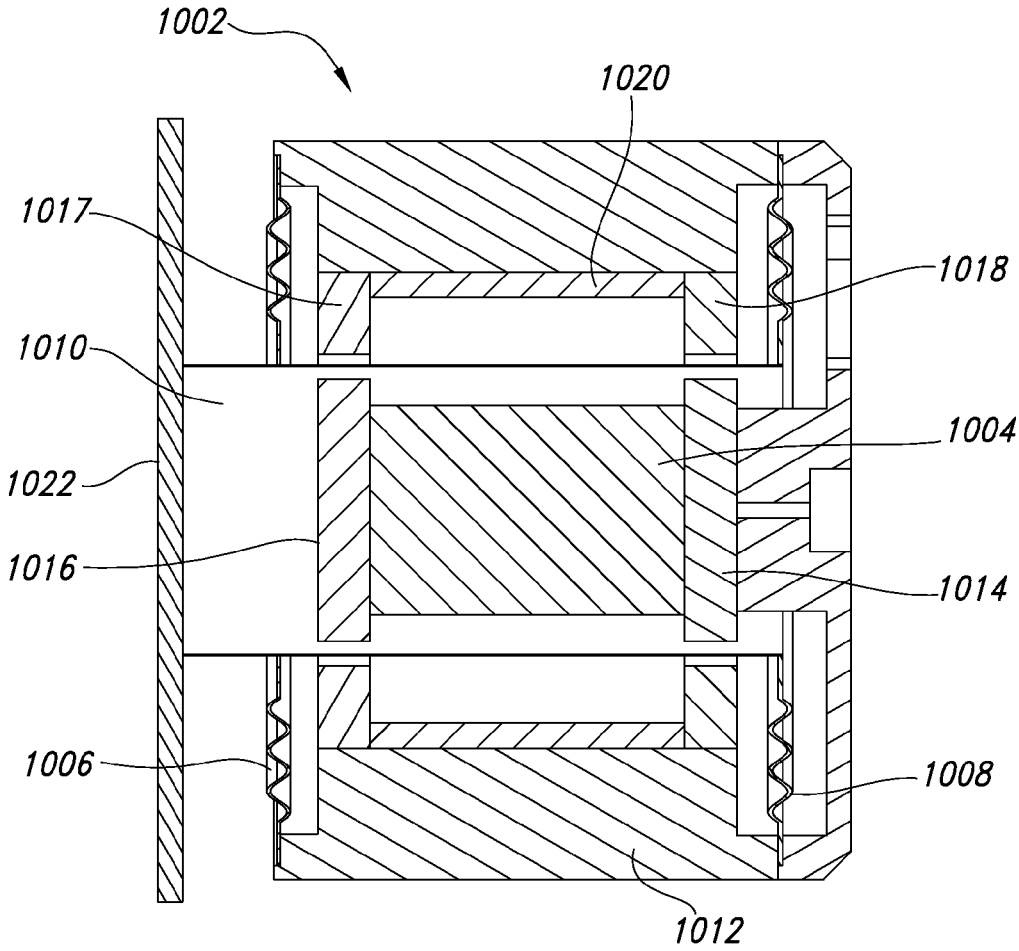
FIG. 10 shows a section view of another transducer design that incorporates dual spiders without a central-connecting rod.

FIG. 10 shows a section view of another transducer design that incorporates dual spiders without a central-connecting rod. Many principal elements of the transducer are the same however, a principal difference between this transducer design and the ones previously disclosed above is that in transducer assembly 1002 of FIG. 10 a magnet 1004 is the center-most part, i.e., the piece at the center of the transducer assembly 1002.

Again, there is a front spider 1006 and a rear spider 1008 which are identical geometries and materials installed in opposing directions to one another. Both are still connected by a glue joint to a voice-coil former 1010 and to a housing 1012. Several steel pieces are integral to the magnetic circuit design; these are a steel back plate 1014 and top plate 1016 which are axially concentric with magnet 1004 and are installed inside voice-coil former 1010. Additional steel parts are an outer-top plate 1017 and the outer back plate 1018; the two are joined by a steel cylindrical shell 1020. It is through this arrangement of steel that a "dual gap" transducer is defined.

At least one, of many differences when viewing this transducer when compared with conventional loudspeakers is that this transducer assembly 1002 (FIG. 10) lacks a basket and surround. Additionally, a discrete non-concentric acoustic-radiating diaphragm 1022 is attached (directly or indirectly) to voice-coil former 1010

Figure 11:
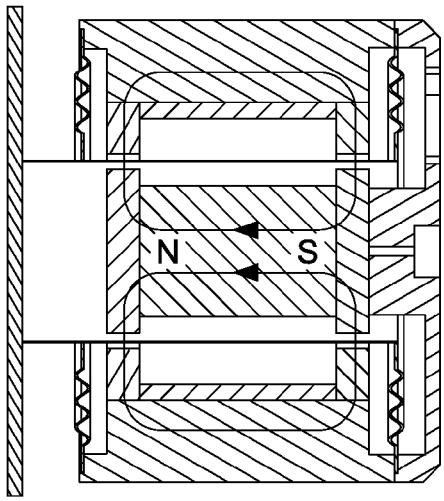
FIG. 11 shows the same section view of the transducer assembly shown in FIG. 10 with magnetic flux line path shown therein.

FIG. 11 shows the same section view of transducer assembly 1002 shown in FIG. 10 with magnetic flux line path shown therein.

Figure 12:
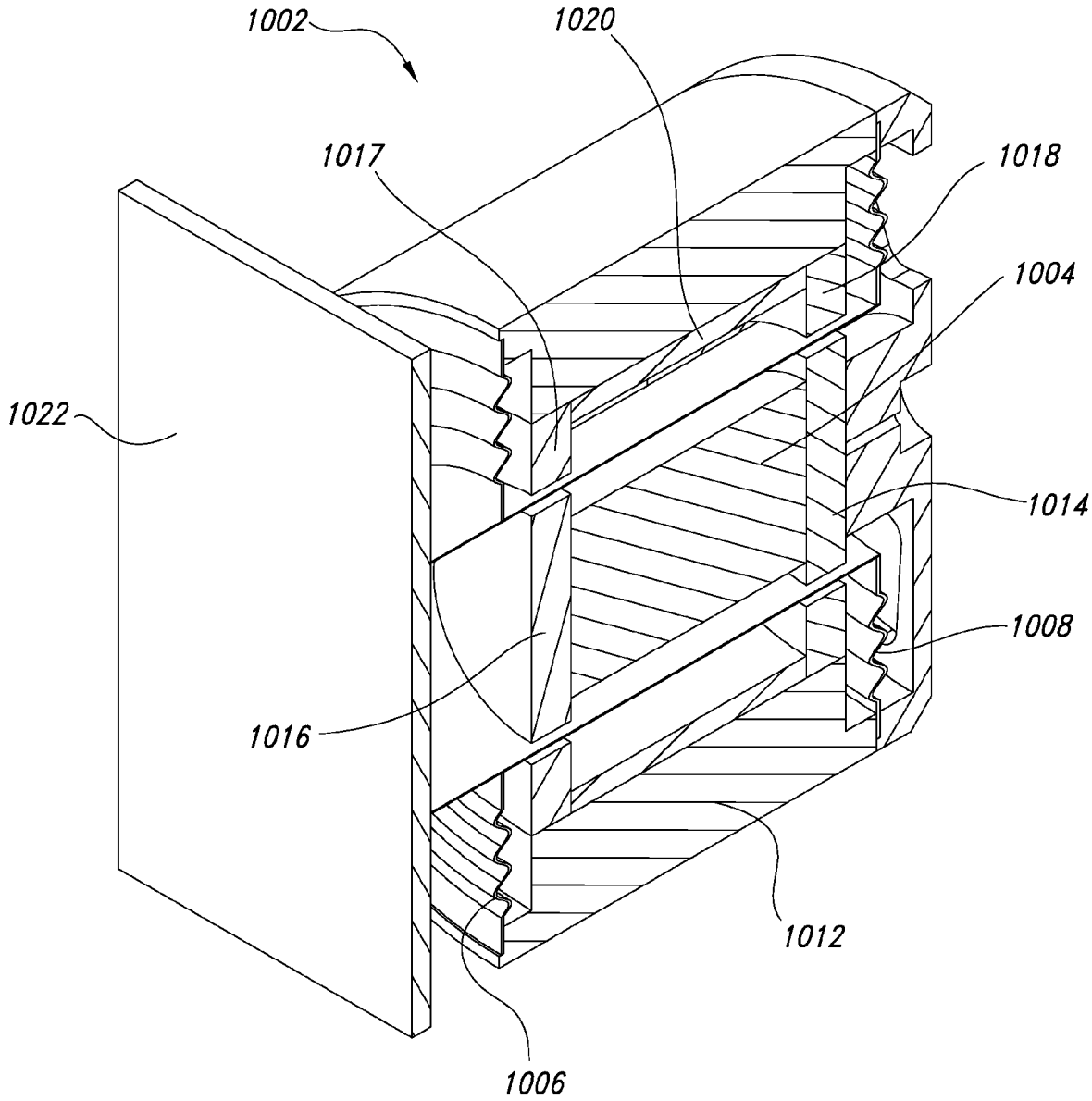
FIG. 12 shows the same device as FIGS. 10 and 11, but is depicted as a solid-sectional-perspective view for understanding.

FIG. 12 shows the same device as FIGS. 10 and 11, but is depicted as a solid-sectional-perspective view for understanding.

4.0 Exemplary Arrays

Figure 13:
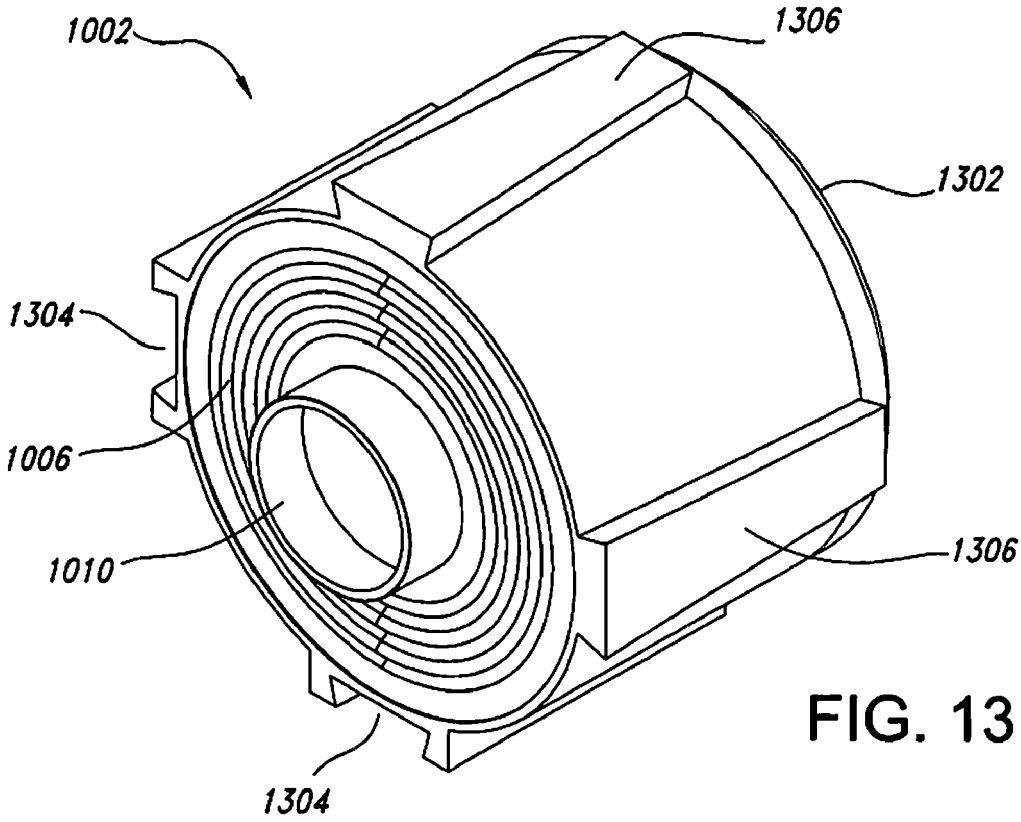
FIG. 13 shows a perspective view of an example transducer assembly in which a housing of a moving-coil transducer is designed to mechanically interlock with adjacent similar devices.

FIG. 13 shows a perspective view of an example transducer assembly (such as 1002 (FIG. 10)) in which a housing 1302 of the moving-coil transducer is designed to mechanically interlock with adjacent similar devices. For example, this housing 1302 has groove 1304 and tongue 1306 fasteners configured to engage tongue and groove fasteners (see FIG. 17 to be described), respectively, of other housings (see FIG. 17). As appreciated by those skilled in the art having the benefit of this disclosure, this is only one of several suitable ways that a housing-to-housing connection may occur. For instance, other housing-to-housing interconnections could be achieved using different mechanical design, ex. flanges and fasteners, hook and eye, etc. It is noted that a sound radiating diaphragm (such as non-concentric acoustic-radiating diaphragm 1022) is omitted from this view for clarity.

Figure 14:
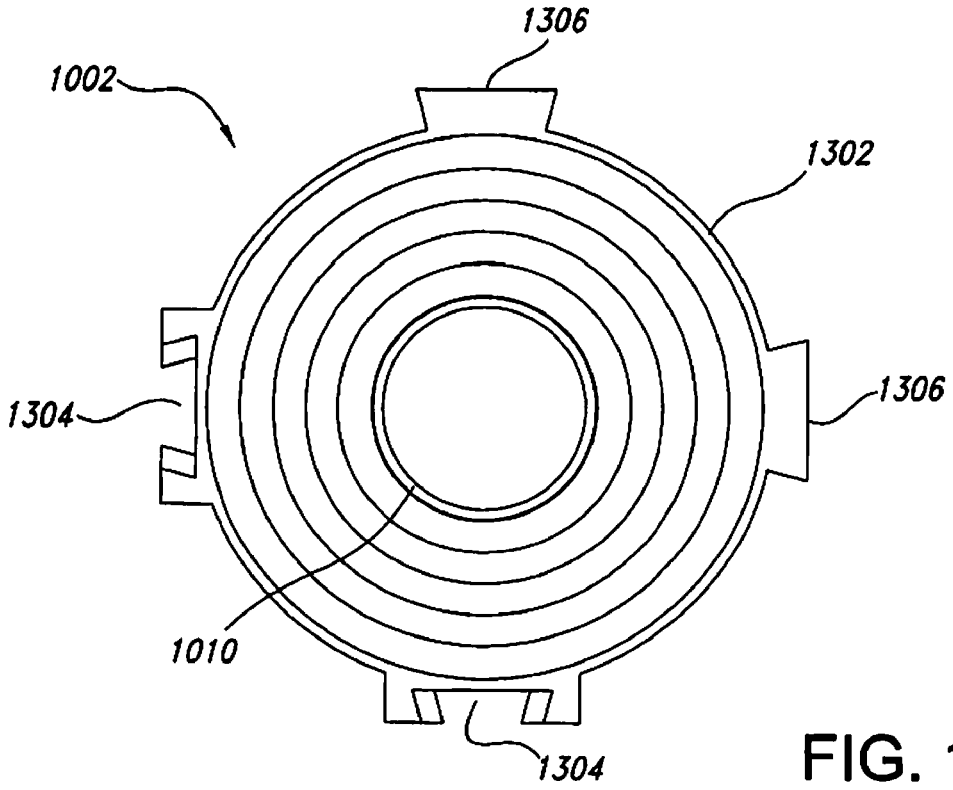
FIG. 14 shows a front view of an example of interlocking housing for a transducer assembly as depicted FIG. 13.

FIG. 14 shows a front view of an example of interlocking housing for a transducer assembly as depicted FIG. 13.

Figure 15:
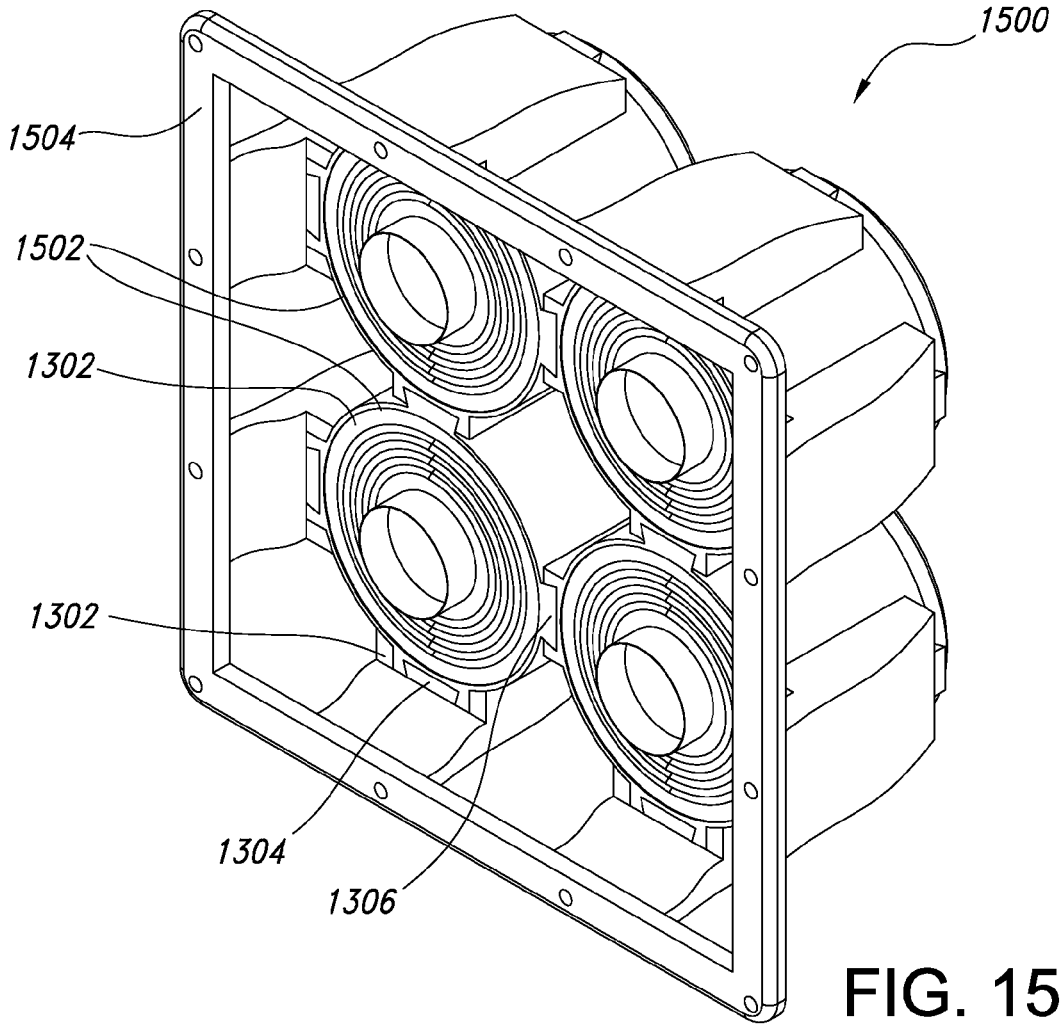
FIG. 15 depicts a perspective view of speaker system in which a plurality of transducer assemblies are interlocked with one another as well as with an outer frame.

FIG. 15 depicts a perspective view of speaker system 1500 in which a plurality of transducer assemblies 1002—forming a 2×2 array 1502—as shown in FIGS. 13 and 14, are interlocked with one another as well as with an outer frame 1504 that joins at the most peripheral elements (transducer assemblies 1002) of array 1502; thus forming one rigid entity of which each individual transducer-assembly housing 1302 is an integral structural member.

Figure 16:
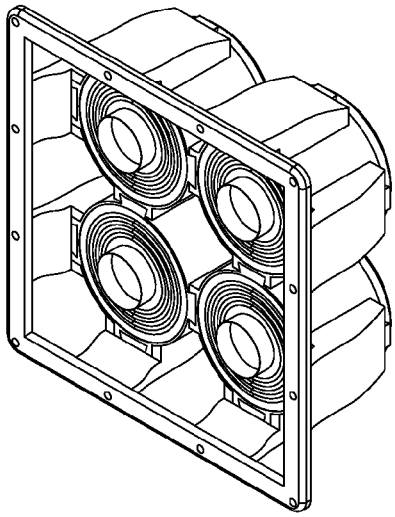
FIG. 16 is a line-perspective view of the speaker system shown in 15.

FIG. 16 is a line-perspective view of the speaker system shown in 15.

Figure 17:
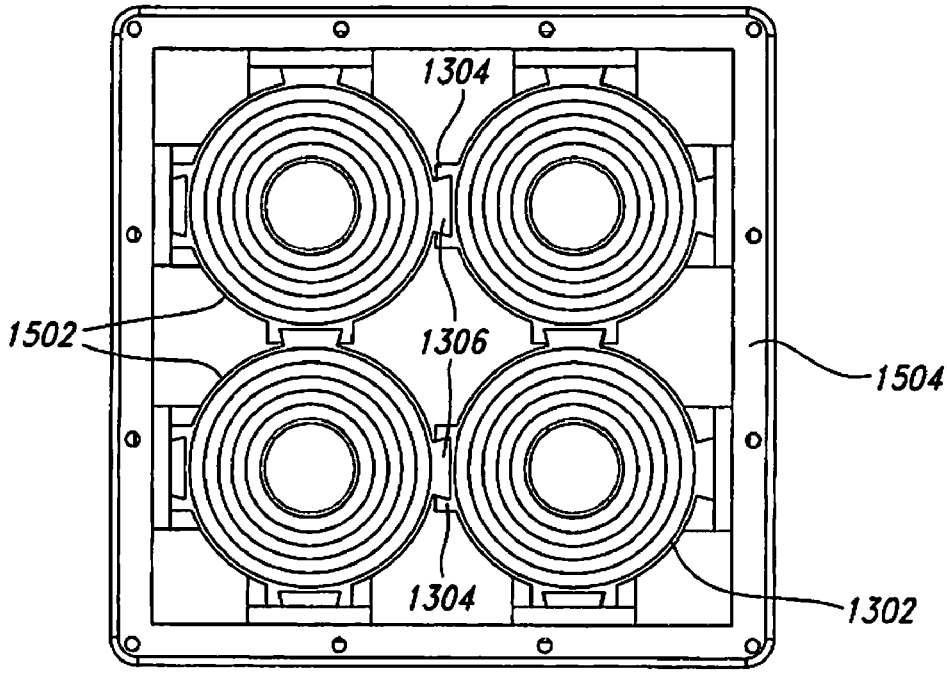
FIG. 17 is a front view of FIGS. 15 and 16.

FIG. 17 is front view of the speaker system showing interlocking housings 1302 with coupled to frame 1504 in FIGS. 15 and 16.

Figure 18:
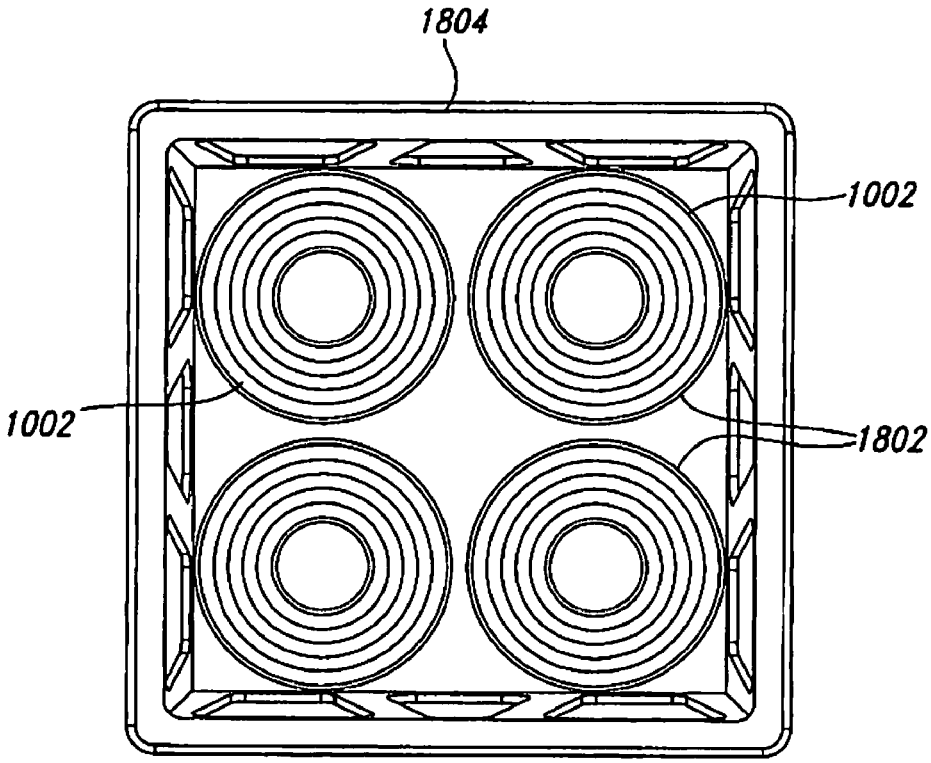
FIG. 18 shows another embodiment of an array of transducer assemblies in which a frame itself, provides a primary support structure for the entire array.

FIG. 18 shows another embodiment of an array 1802 of transducer assemblies 1002 in which frame 1804 itself, provides a primary support structure for the entire array 1802. As depicted in FIG. 18, each transducer assembly 1002 is mechanically joined to frame 1804 and is independent from other transducer housings. As appreciated by those skilled in the art having the benefit of this disclosure, there are a myriad of suitable ways to attach (directly/indirectly) the transducer to frame 1804, including, but not limited to, mechanical fasteners, clips, adhesives, rivets, and so forth.

Figure 19:
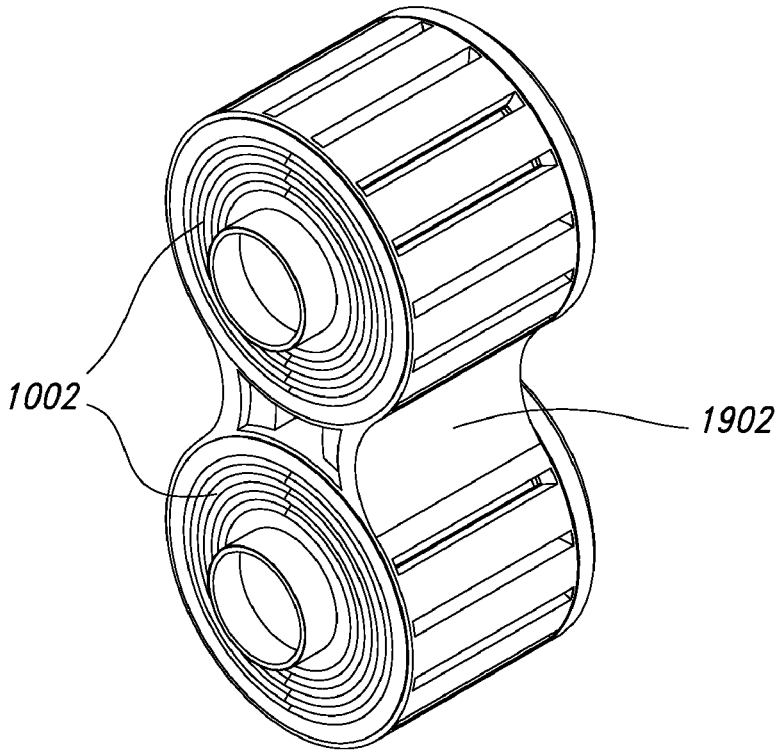
FIG. 19 is perspective view of an exemplary housing piece that joins two identical transducer assemblies non-concentrically.

FIG. 19 is perspective view of an exemplary housing piece 1902 that joins two identical transducer assemblies 1002 non-concentrically.

Figure 20:
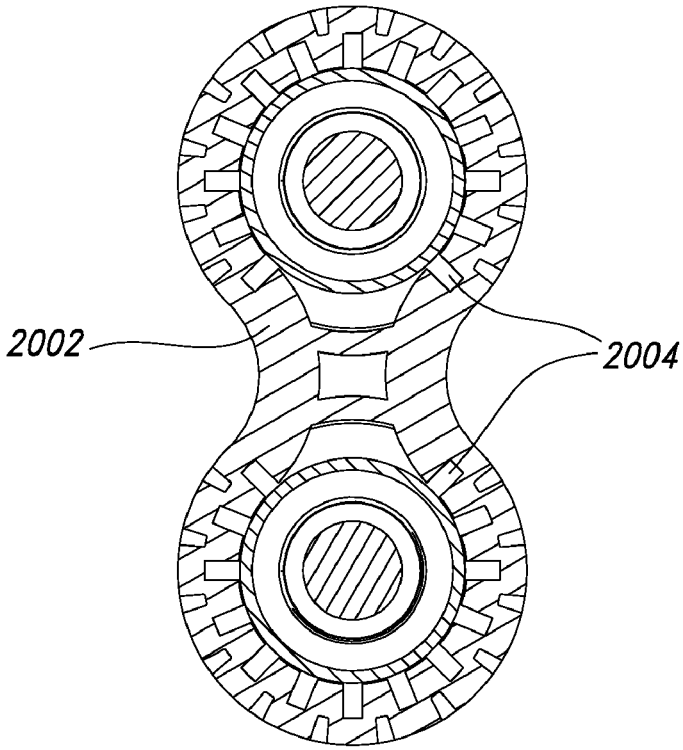
FIG. 20 is a front-section view of another dual housing piece with heat-sinking fins.

FIG. 20 is a front-section view of another dual housing piece 2002, which is similar to housing piece 1902 of FIG. 19. Housing piece 2002, however, includes heat-sinking fins 2004. Multi-transducer housing pieces as depicted in FIGS. 19 and 20 are only one example of the types of housings that can be used to join multiple transducer assemblies, as would be appreciated by those skilled in the art, after having the benefit of this disclosure.

Figure 21:
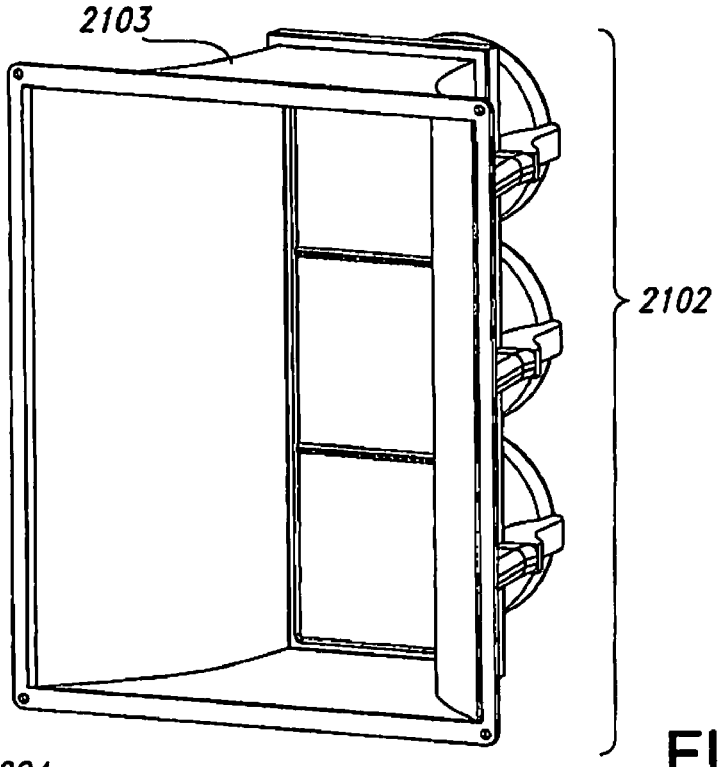
FIG. 21 shows a perspective view of a transducer array coupled to an acoustic horn.

FIG. 21 shows a perspective view of a transducer array 2102 coupled to an acoustic horn 2103.

Figure 22:
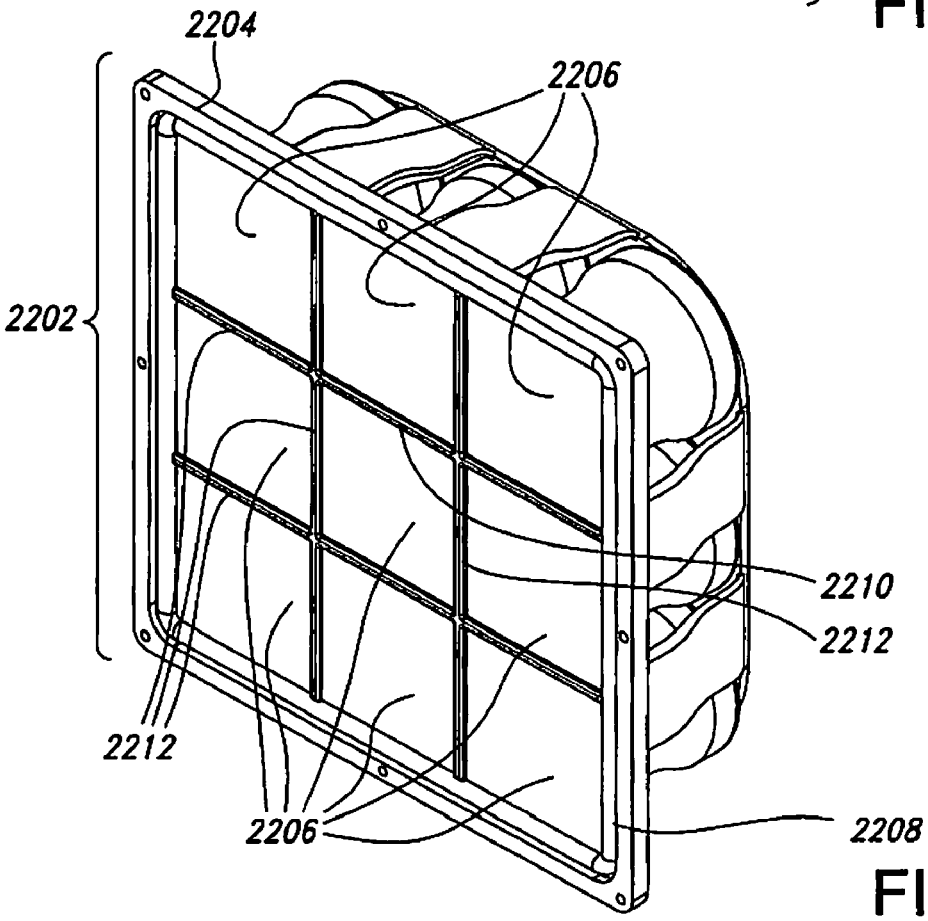
FIG. 22 shows a perspective view of a 3×3 transducer array.

FIG. 22 shows a perspective view of a 3×3 transducer array 2202 in a frame 2204 in which the plurality of radiating segments (i.e., discrete non-concentric acoustic-radiating diaphragms) 2206 are surrounded by an outer surround 2208 which may be made of corrugated paper, rubber or other suitable compliant materials. Radiating surfaces 2206 of the transducers are joined at their internal edges 2210 by another compliant material (i.e., flexible-joint structure) 2212; which may include silicone or another suitable adhesive that is flexible and impervious to air, or rubber. That is interior perimeter edges 2210 are adjacent to each other. A flexible-joint structure 2212 may be attached around interior and/or exterior perimeters of the diaphragms. In one implementation, flexible-joint structure 2212 may composed of rubber, plastic, lead, metal, composite materials, or other suitable materials as would be appreciated by those skilled in the art with the benefit of having this disclosure.

Figure 23:
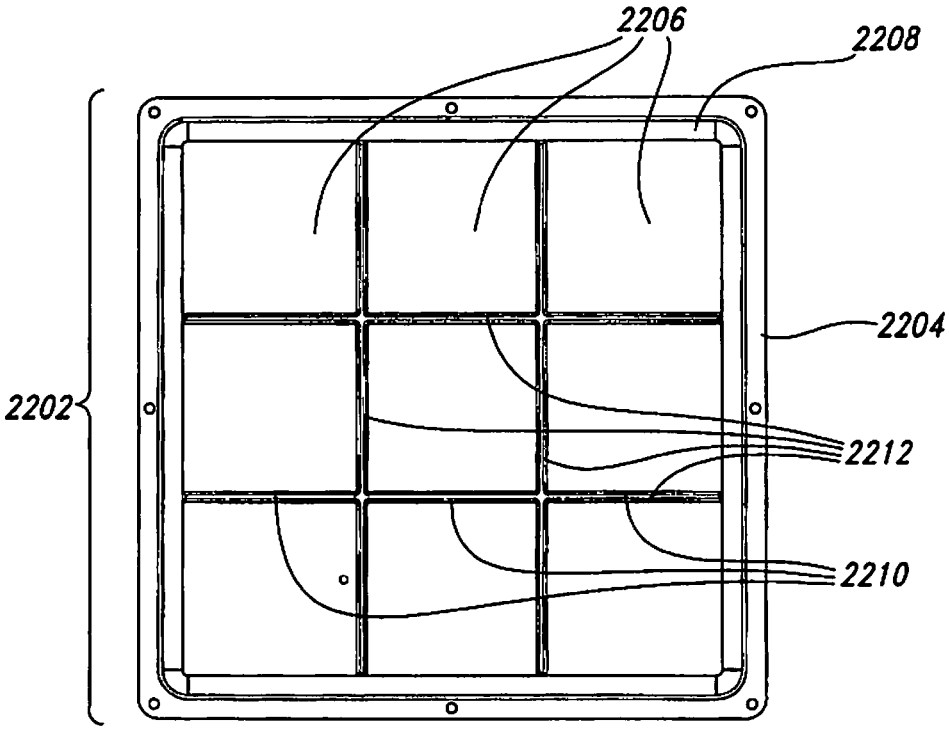
FIG. 23 is a front-line view of the same 3×3 transducer array shown in FIG. 22.

FIG. 23 a front-line view of the same 3×3 transducer array 2202 in a frame 2204 shown in FIG. 22.

Figure 24:
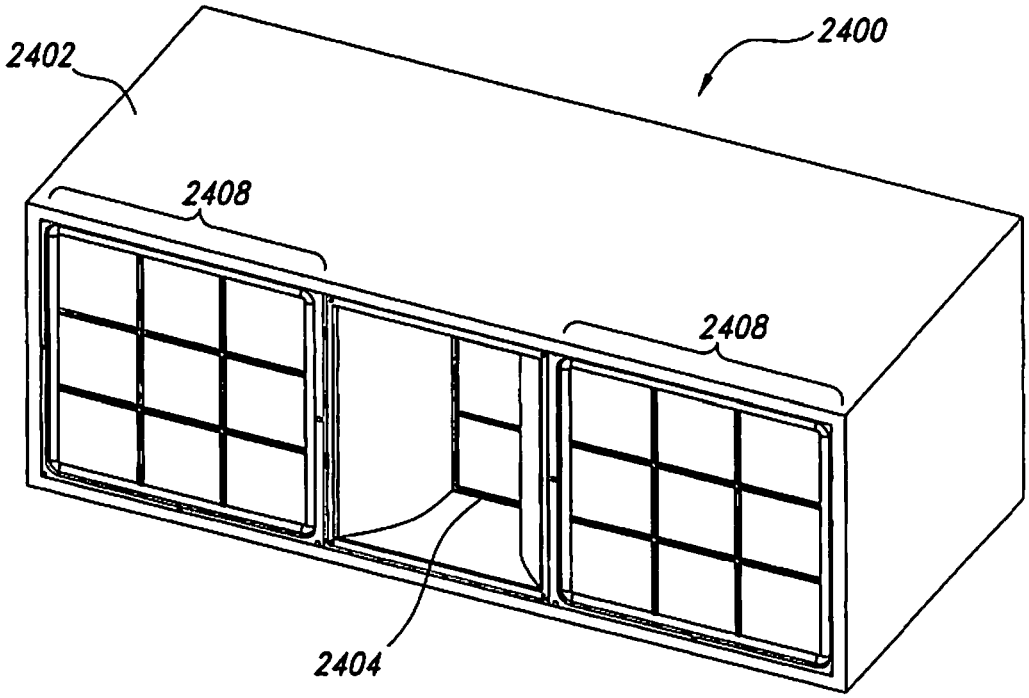
FIG. 24 shows an example of loudspeaker system including an enclosure, which separates the air on the front side of the transducer arrays from the air on the back side.

FIG. 24 shows example of a loudspeaker system 2400 including an enclosure 2402 which separates the air on the front side of the transducer arrays from the air on the back side. Centrally located is a transducer array 2404 coupled to an acoustic horn or wave guide 2406 which is flanked by two identical 3×3 transducer array modules 2408. Transducer array 2404 coupled to the horn 2406 may consist of different transducers than those arrayed in the direct radiating transducer array modules 2408. Accordingly, each array or modular section may be configured to operate at a specific audio bandwidth. In other words, each array module may be optimized to reproduce sounds at specific frequency bandwidths.

As appreciated by those skilled in the art, conventional loudspeakers may be included as a component within an enclosure such as shown in FIG. 24. For example, the central transducer array 2404 may be replaced with a conventional combination of a compression driver, or appropriate transducer driver, or horn.

Figure 25:
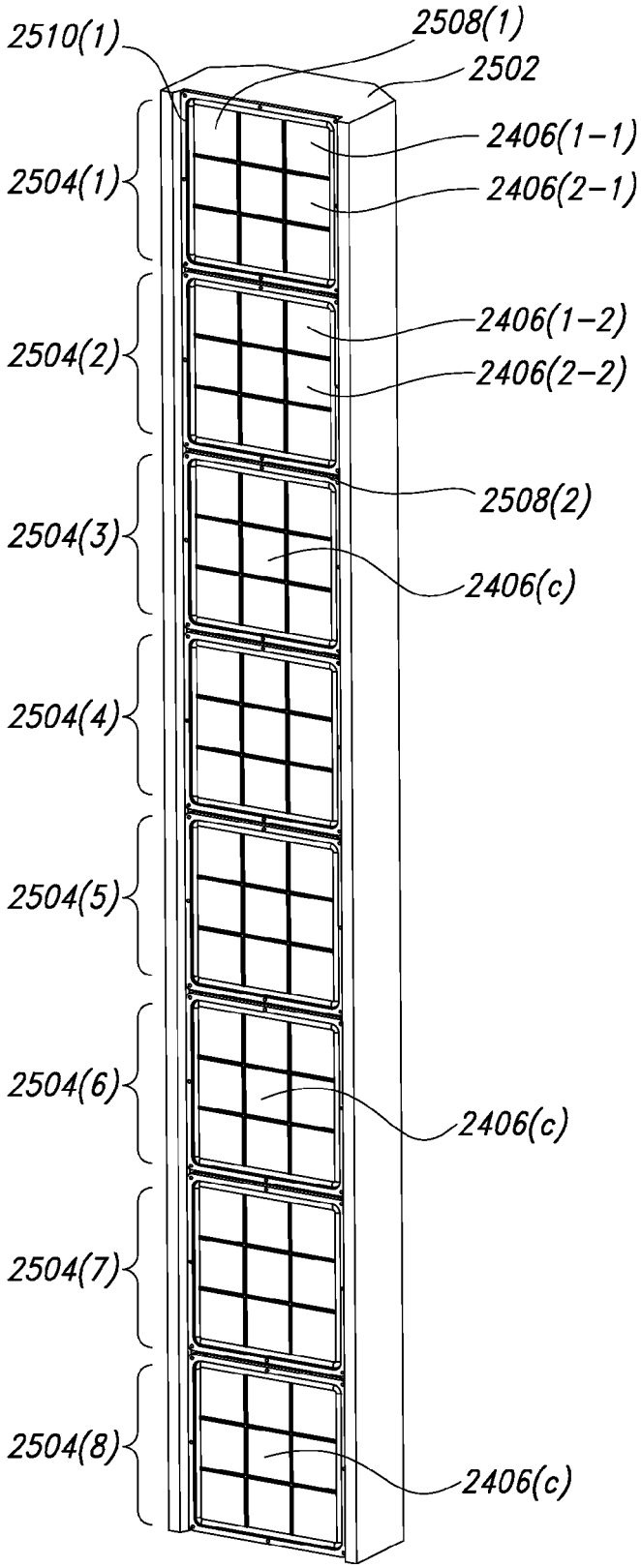
FIG. 25 shows an exemplary line array consisting of eight transducer-array modules.

FIG. 25 shows an exemplary line array 2502 including eight transducer-array modules 2504(1), 2504(2), . . . 2405 (8), each containing a plurality of piston-based transducers (shown earlier figures such as, but not limited to, reference 1002 in FIG. 10 and transducer assembly 112 in FIG. 1). Each transducer assembly is configured to drive a particular one of a plurality of discrete non-concentric acoustic-radiating diaphragms 2406(1-1) 2406(2-1) . . . , 2406(1-2), . . . 2406 (N-N) etc. Frame 2508(1), 2508(2), . . . 2508(8) corresponding to each module 2504(1), 2504(2), . . . , 2504(8) respectively, is positioned around an outermost boundary 2510 of the plurality of the discrete non-concentric acoustic-radiating diaphragms 2406 for which it surrounds. That is, each frame, referred to generally as 2508, is adjacent to an outermost boundary of each module 2504 (i.e., the peripherally located diaphragms 2406 each module. Those diaphragms 2406(*c*) located toward the inner portions of each module 2504 that are not adjacent to boundary 2510, are joined to other inner peripheral edges 2422 by flexible-joint structure as describe above with reference to FIG. 22.

As appreciated by those skilled in the art, although each frame is described as a discrete part for purposes of this description, it is possible that only a single integral frame may be used which has different open sections corresponding to each module.

Figure 26:
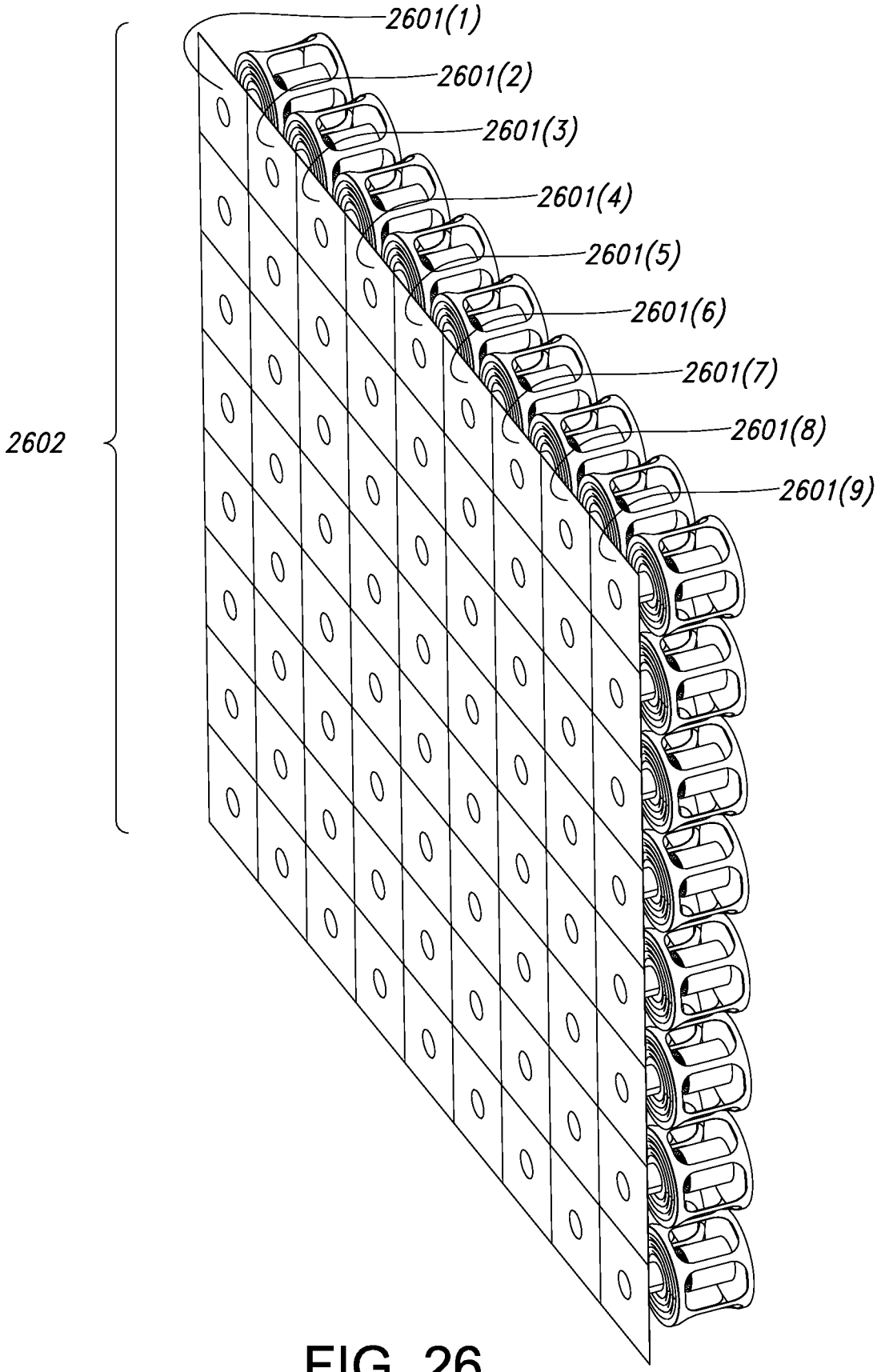
FIG. 26 shows a perspective view of a plurality of loud speakers implemented in an array.

FIG. 26 shows a perspective view of a plurality of loud speakers 2600 implemented in an array 2602. As depicted in FIG. 26, each acoustic-radiating surface 2601(1) . . . , 2601 (N) may function as a single unit with minimal space between adjacent speakers in array 2602. This reduces destructive interference and enhances constructive interference in the sound fields produced by each unit. That is, maximizing a radiating surface area by using multiple acoustical-radiating surfaces to act as one single continuous flat panel, leaves less room for acoustical dead spots in the listening area. As appreciated by those skilled in the art having the benefit of this disclosure, speakers 2600 may be employed in other array configurations, such as line, planar, and phased arrays.

As described above with reference to the exemplary transducer implementations, by eliminating a conventional traditional basket, and surround, it is heretofore possible to minimize the spacing between adjacent sound units in an array, and achieve a common sound. As a result, it is now possible to reduce destructive interference, and enhance constructive interference in the sound fields produced by the sound units produced by an array (i.e. a plurality of discrete acoustic-radiating diaphragms). In other words, maximizing the radiating-surface area, leaves less room for acoustical-dead spots in a listening area.

5.0 Exemplary-Wiring Constructs

FIGS. 27-32 show exemplary wiring configurations (schematic diagrams) for a modular-transducer array as shown above.

All example wiring configurations are based on an array that is 2×2 (two rows high, by two columns wide). The array index of each element (i.e., transducer) is given on the schematics in the form of an ordered pair, (m,n). It is appreciated by those skilled in the art that 2×2 array only one example for discussion purposes, and that the different configurations for the array is infinite. So, the array may be larger or smaller than depicted in these figures.

There is often reference to "input terminals" in the following. This means a pair (one positive contact (+) and one negative contact (−)) of electrical contacts by which an external voltage source may be connected to the load circuit.

Figure 27:
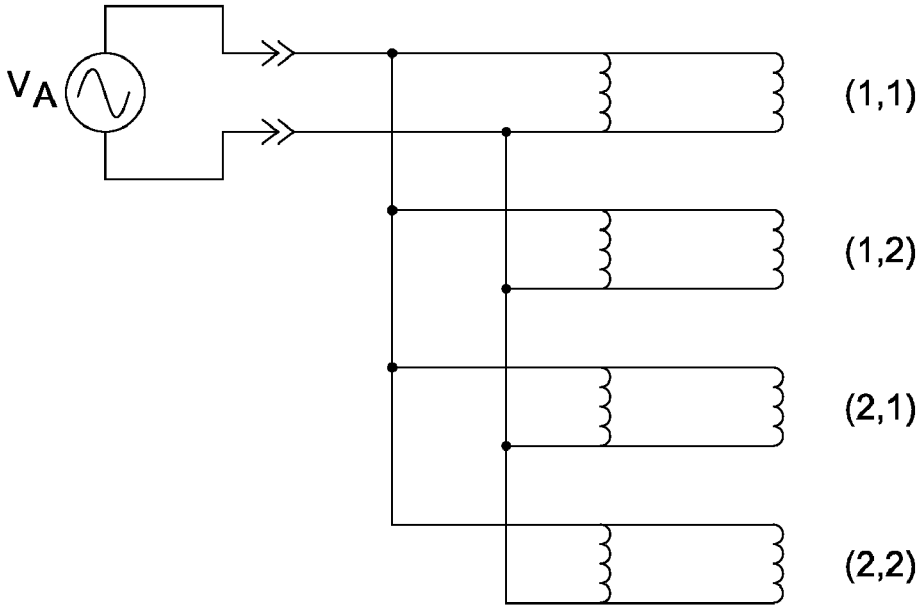
FIGS. 27-32 show exemplary wiring configurations (schematic diagrams) for a modular-transducer array.

Specifically, FIG. 27 depicts an exemplary wiring configuration in which all voice coils of all four transducers are wired in parallel to one set of terminals. The general description of this configuration is "all arrayed devices wired in parallel to one set of input terminals". So, according to FIG. 27, there is a pair of positive and negative electrical terminals, drive a plurality of piston-based inductors in unison as a unit, with the plurality of piston-based inductors being electrically wired in parallel.

Figure 28:
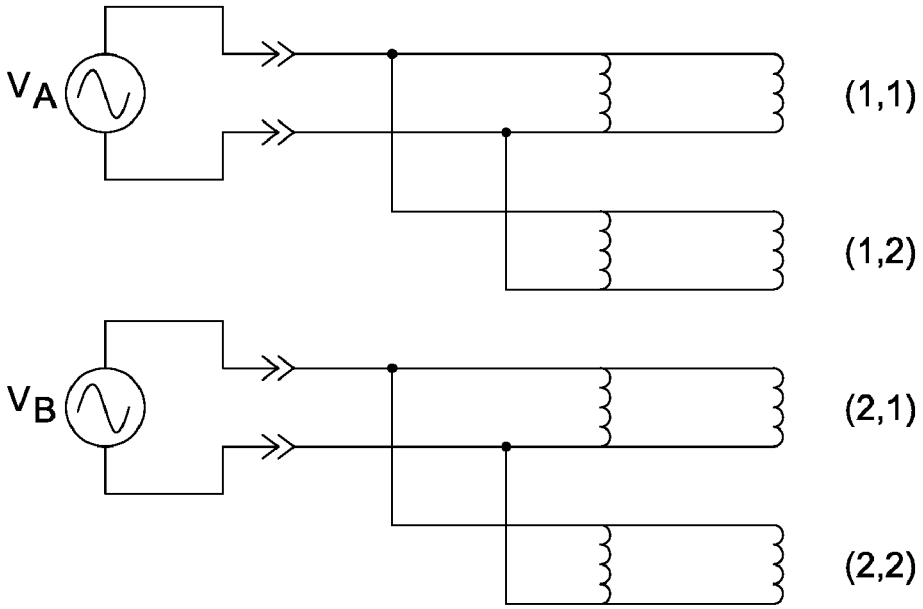

FIG. 28 depicts a wiring configuration in which the top row of array transducers are wired in parallel with one another to one set of input terminals, while the bottom row of array elements are wired in parallel with another set of input terminals. The general interpretation of this is that combinations voice coils of array rows or columns may be wired in parallel with one another with each parallel combination having a separate input connection.

Figure 29:
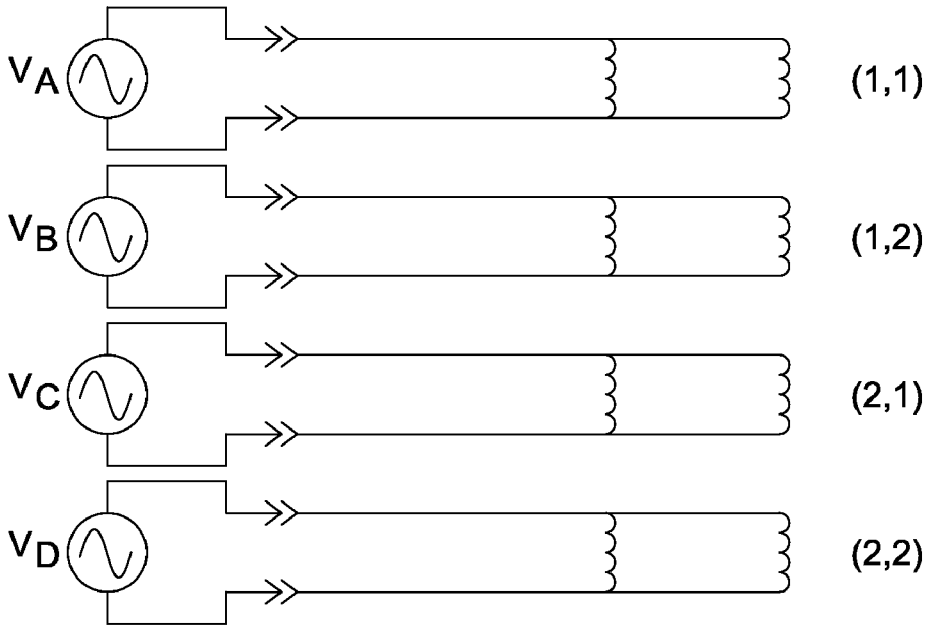

FIG. 29 shows a plurality of pairs of positive and negative electrical terminals, with each pair of positive and negative electrical terminals driving a respective one of the plurality of piston-based inductors individually. Also, these plurality of piston-based inductors are electrically wired in series. Or in other words, FIG. 29 shows a configuration in which each array element (transducers) has its own unique set of input terminals.

Figure 30:
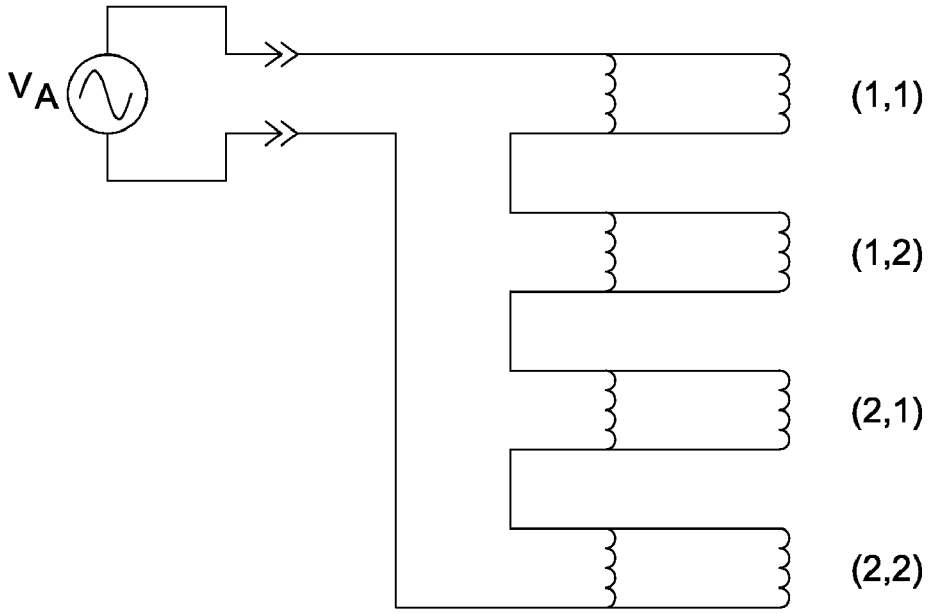

FIG. 30 shows a configuration in which pairs of voice coils which are common to the same linear transducer are in parallel, but array elements are wired in series with one another. The series combination of all of the motors is wired to one set of input terminals.

Figure 31:
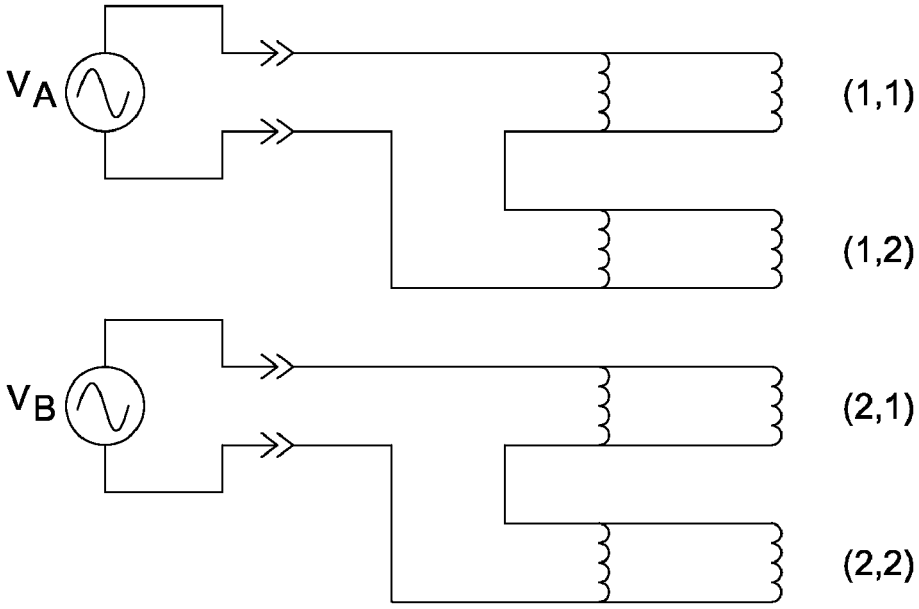

FIG. 31 shows a configuration in which the top row of array elements are wired in series with each other as are the elements of the bottom row. Each series has its own set of input terminals.

Figure 32:
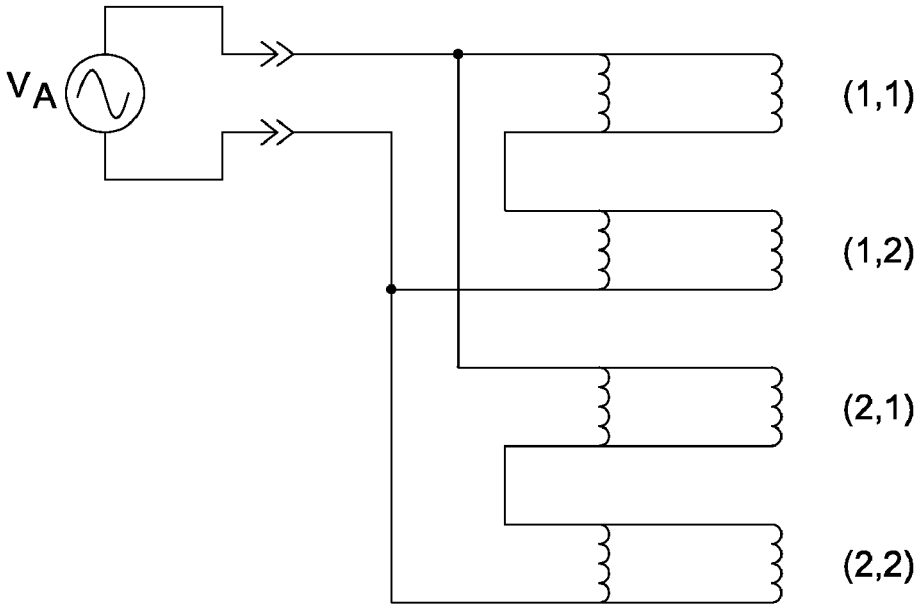

FIG. 32 shows another configuration in which the rows are wired in series and the columns are wired in parallel with one another to one set of input terminals.

The embodiments described herein are to be considered in all respects only as exemplary and not restrictive. The scope of the invention is, therefore, indicated by the subjoined Claims rather by the foregoing description. All changes which come within the meaning and range of equivalency of the Claims are to be embraced within their scope.

What is claimed is:

1. A loudspeaker system, comprising:

a first transducer having a first-voice-coil former, configured to move linearly along a horizontal axis, the first transducer also having a central chamber;

a first spider and a second spider; the first spider and the second spider having planar outer-and-inner surfaces extending along a vertical axis with each inner surface generally in parallel and opposing each other, wherein the first transducer is disposed between the inner surfaces of the first spider and the second spider;

a shaft, extending, at least in part, through the central chamber of the first transducer and along the horizontal axis, the shaft configured (i) to move along the horizontal axis in unison with the first-voice-coil former and (ii) to provide a mechanical linkage, at least in part, between the first spider and the second spider.

2. The loudspeaker system of claim 1, further comprising a second transducer having a central chamber, wherein the shaft is further configured to extend, at least in part, through the central chamber of the second transducer, wherein the second transducer is positioned between the inner surfaces of the first spider and the second spider.

3. The loudspeaker system of claim 1, further comprising an acoustic-radiating diaphragm, connected to the first-voice-coil former of the first transducer, the acoustic-radiating diaphragm positioned generally in parallel with and a predefined distance away from the outer-surface of the first spider.

4. A loudspeaker, comprising:

first- and second-compliant members positioned a predefined distance away from each other, each having inner and outer surfaces that are generally planar and extend along a vertical axis, wherein the inner surfaces oppose each other, and are generally in parallel with respect to each other;

a first transducer positioned between the inner-planar surfaces of the first and second compliant members, the first transducer having a voice-coil former that moves along a horizontal axis generally perpendicular to the vertical axis, wherein a portion of the voice-coil former is fastened to a central section of the first-compliant member; and a shaft extending along the horizontal axis and positioned within a passageway within the first transducer, the shaft providing, at least in part, a mechanical linkage between the voice-coil former, and a central section of the second-compliant member, wherein the first and second-compliant members are configured to support and suspend the voice-coil former, and to permit reciprocating motion of the voice-coil former along the horizontal axis, when the first transducer is operational.

5. The loudspeaker as recited in claim 4, further comprising an acoustic-radiating diaphragm, connected to the voice-coil former, the acoustic-radiating diaphragm positioned generally in parallel with, and a predefined distance away from, the outer-surface of the first-compliant member.

6. The loudspeaker as recited in claim 4, further comprising a housing, wherein outer-peripheral edges of the first- and second-compliant members are fastened to the housing.

7. The loudspeaker as recited in claim 4, further comprising a housing, wherein at least a portion of the first transducer is fastened to the housing.

8. The loudspeaker as recited in claim 4, wherein the first- and second-compliant members are generally cylindrical in shape.

9. The loudspeaker as recited in claim 4, wherein the first- and second-compliant members are spiders.

10. The loudspeaker as recited in claim 4, wherein the first transducer further includes the following elements which are generally concentric about the horizontal axis:

a pole piece adjacent to, but spaced apart from the shaft, wherein the pole piece has a larger circumference than the shaft;

a voice coil positioned around a section of the voice-coil former, with the voice-coil former adjacent to, but spaced apart from the pole piece, wherein the voice-coil former has a larger circumference than the pole piece; and one or more magnets secured to a housing in a cylindrical fashion, the one or more magnets adjacent to the voice coil and the voice-coil former, but spaced apart from the voice coil and the voice-coil former, wherein the one or more magnets, collectively, have a larger circumference than the voice coil or the voice-coil former.

11. The loudspeaker as recited in claim 4, further comprising a second transducer having a voice-coil former that moves, along the horizontal axis in unison with the voice-coil former of the first transducer, and generally perpendicular to the surfaces of the first-and-second-compliant members, wherein the shaft, further provides, at least in part, a mechanical linkage between the voice-coil former of the first transducer with the voice-coil former of the second transducer.

12. The loudspeaker as recited in claim 11, further comprising:

a first disc attached to a first-end section of the shaft proximal to the first-compliant member, wherein the disc has an external perimeter surface that is adjacent to and coextensive with at least a portion of an inner surface of the voice-coil former; and a second disc attached to a second-end section of the shaft proximal to the second-compliant member, wherein the disc has an external perimeter surface that is adjacent to and coextensive with at least a portion of an inner surface of the second voice-coil former.

13. The loudspeaker as recited in claim 4, further comprising a disc joined to the shaft, wherein the disc has an external perimeter surface that is adjacent to and coextensive with at least a portion of an inner surface of the voice-coil former.

14. A loudspeaker, comprising:

a stationary assembly comprising a housing and a magnetic assembly both of which remain in a fixed position relative to each other;

a moving assembly comprising an acoustic-radiating diaphragm, and a voice-coil assembly, both configured to move back and forth in a linear fashion along a horizontal axis, and in unison with each other in response to electro-magnetic energy being exchanged between the voice-coil assembly and the magnetic assembly when the loudspeaker is operational, the movement causing acoustic waves to be emitted from a front surface the acoustic-radiating diaphragm;

an axial-stability assembly comprising: (i) a front-compliant member interposed between the acoustic-radiating diaphragm and the magnetic assembly, the front-compliant member having a planar surface extending along a vertical axis which is perpendicular to the horizontal axis, wherein the front-compliant member is also interposed, at least in part, between the voice-coil assembly and the housing, wherein a central portion of the front-compliant member is connected between the voice-coil assembly the housing, (ii) a rear-compliant member positioned substantially in parallel with the front-compliant member; and (iii) a shaft mechanically connecting, at least in part, the voice-coil assembly to a central portion of the rear-compliant member; wherein the shaft is configured to move in a linear fashion in unison with the voice-coil assembly; wherein the axial-stability assembly is configured to provide axial stability to the voice-coil assembly as well as to provide an opposing-resistive-spring force to linear movement of the voice-coil assembly.

15. A loudspeaker, comprising:

a stationary assembly comprising a housing and a magnetic assembly both of which remain in a fixed position relative to each other;

a moving assembly comprising an acoustic-radiating diaphragm, and a voice-coil assembly configured to move back and forth in a linear fashion, and in unison with each other in response to electro-magnetic energy being exchanged between the voice-coil assembly and the magnetic assembly, whereby the movement causes acoustic waves to be emitted from a front surface the acoustic-radiating diaphragm;

a stability assembly comprising a front-compliant member positioned behind a back surface of the acoustic-radiating diaphragm, the front-compliant member interposed, at least in part, between the voice-coil assembly and the housing, a rear-compliant member positioned substantially in parallel with the front-compliant member; and a central member mechanically connecting the voice-coil assembly to a central portion of the rear-compliant member; wherein the central member is configured to move in a linear fashion in unison with the voice-coil assembly; wherein the stability assembly is configured to provide axial stability to the voice-coil assembly.

* * * * *